US005343899A

United States Patent [19]

Jacobsson et al.

[11] Patent Number: 5,343,899

[45] Date of Patent: Sep. 6, 1994

[54] OUTPUT YARN BRAKE

[75] Inventors: Kurt A. G. Jacobsson, Ulricehamn; Lars-Berno Fredriksson, Kinna, both of Sweden

[73] Assignee: IRO AB, Ulricehamn, Sweden

[21] Appl. No.: 952,850

[22] PCT Filed: Mar. 12, 1991

[86] PCT No.: PCT/SE91/00185

§ 371 Date: Nov. 12, 1992

§ 102(e) Date: Nov. 12, 1992

[87] PCT Pub. No.: WO91/14032

PCT Pub. Date: Sep. 19, 1991

[30] Foreign Application Priority Data

| | | | |
|---|---|---|---|
| Mar. 12, 1990 | [SE] | Sweden | 9000881-4 |
| Mar. 13, 1990 | [SE] | Sweden | 9000911-9 |
| Mar. 19, 1990 | [SE] | Sweden | 9000997-8 |
| Nov. 13, 1990 | [SE] | Sweden | 9003624-5 |
| Nov. 18, 1990 | [SE] | Sweden | 9003680-7 |
| Nov. 29, 1990 | [SE] | Sweden | 9003813-4 |
| Jan. 7, 1991 | [SE] | Sweden | 9100066-1 |

[51] Int. Cl.[5] ..... D03D 47/34

[52] U.S. Cl. ..... 139/452; 242/47.01

[58] Field of Search ..... 242/47.01, 147 R, 128; 139/452

[56] References Cited

U.S. PATENT DOCUMENTS

| | | | |
|---|---|---|---|
| 3,761,031 | 9/1973 | Pfarrwaller . | |
| 3,834,635 | 9/1974 | Pfarrwaller . | |
| 4,068,807 | 1/1978 | Jacobsson . | |
| 4,079,759 | 3/1978 | Riha et al. . | |
| 4,153,214 | 5/1979 | Savio et al. . | |
| 4,429,723 | 2/1984 | Maroino | 139/452 |
| 4,478,375 | 10/1984 | Sarfati et al. | 242/47.01 |
| 4,574,847 | 3/1986 | Matsumoto . | |
| 4,744,394 | 5/1988 | Lincke . | |
| 4,785,855 | 11/1988 | Benz et al. . | |
| 4,799,517 | 1/1989 | Bucher . | |

FOREIGN PATENT DOCUMENTS 0357975 3/1990 European Pat. Off. .

*Primary Examiner*—Andrew M. Falik

*Attorney, Agent, or Firm*—Flynn, Thiel, Boutell & Tanis

[57] ABSTRACT

An easily movable output brake system forms part of or cooperates with a yarn feeder (13) comprising a spatially fixed body supporting a yarn store, from which body a yarn (11) can be drawn off even at advanced speed through an output channel (10). The system comprises a first member (9) which is arranged in a bearing and which, in the functional operation of the system, by means of a surface clamps the yarn being drawn off against a counterstay member (15). The members (9, 15) are designed to effect a yarn-cleaning function dependent on the yarn rotation upon drawing-off, with simultaneous prevention of considerable accumulation of lint, particles etc., in respect of the members. The mobility of the system is obtained by the selection of the components in question. The mobility gives an instantaneous yield and instantaneous return to the previously exerted braking/tensioning effect of a knot on the passing yarn and/or an instantaneous response to one or more controls for modifying the braking or tensioning force of the system during one and the same drawing-off of yarn (machine cycle).

59 Claims, 15 Drawing Sheets

OUTPUT YARN BRAKE

FIELD OF THE INVENTION

The present invention relates to an arrangement for an easily movable output brake system for yarn in a yarn feeder (furnisher) which comprises a spatially fixed body which supports a yarn store and from which a yarn can be drawn off even at advanced speed through an output channel. The system comprises a first member which is arranged in a bearing and which, in the functional operation of the system, by means of a surface clamps the yarn being drawn off against a counterstay member.

BACKGROUND OF THE INVENTION

It is previously known to arrange controlled (alt. non-controlled) output yarn braking on yarn feeders. A known brake uses a spring member which is applied over the yarn path with one or more eye-shaped parts which can be tightened and slackened by means of the control member acting on the ends of the spring member. On tightening/slackening, the pressing against the yarn and the counterstay surface is modified (see e.g. U.S. Pat. No. 4,785,855, FIGS. 4–7).

It is also known to arrange individual spring members which are placed around the periphery of the yarn-storing part of the storing body of the yarn feeder. The spring members are in principle secured at their first ends and bear with their free ends against the yarn and press the latter against the underlying surface on the yarn-storing part of the storing body of the yarn feeder (see e.g. U.S. Pat. No. 4,785,855, FIGS. 2 and 3).

It is already known to control such spring elements in order to produce a yarn-braking function in which the spring elements press the yarn to a greater or lesser extent against a peripheral surface on the spool body of the yarn feeder.

It is thus previously known to provide brake arrangements which modify the yarn tensioning during the respective pick in the weaving machine. For example, in a projectile weaving machine, the yarn tensioning (brake effect) will be low or zero at the start of the drawing-off process as the projectile accelerates to its maximum speed. Thereafter, the yarn tensioning (brake effect) should be increased in the brake arrangement on account of the fact that the projectile slows down in its movement towards its other end position, and the yarn balloon formed on the bearing body on account of the drawing-off function would otherwise, as a result of the mass and movement of the yarn, "catch up with" the yarn part running out from the brake arrangement and would cause problems in respect of the brake arrangement. It is therefore desired to adapt the yarn drawing-off (yarn tensioning) to the movement of the projectile in the weaving process. A number of proposals for solving this problem are already known.

For example, in gripper machines, it is desirable to be able to produce a half-wave sinusoidal variation of the braking function/yarn-tensioning function. The first gripper draws out the yarn during an acceleration stage which is followed by a deceleration stage so that the yarn speed upon changeover to the subsequent gripper member is virtually zero. Such a variation also causes problems, since the accelerated yarn mass at the drawing-off point on the storing body must be prevented from pressing against the brake-effecting parts and causing disturbances (entangling tendencies).

It is known to use a controlled brake/tension-generating unit of the type which comprises two surface-supporting parts which can be placed opposite each other and which can be mutually influenced in directions towards and away from each other and between which a thread part running out from the thread store of the thread-storing member is passed during the thread drawing-off from the said member. The first surface-supporting part is positioned at or on the end surface of the thread-storing member, or alternatively consists of a part of the said end surface, and the second surface-supporting part is arranged on a unit situated outside the said end surface.

It is also known to arrange a non-controlled brake for thread-storing members, and the known brake is in this case of the type comprising two surface-supporting parts which can be placed opposite each other and which can be mutually influenced in directions towards and away from each other and between which a thread part running out from the thread store of the thread-storing member is passed during the thread drawing-off. The first surface-supporting part is placed at or on the end surface of the thread-storing member and the second surface-supporting part is arranged on a unit situated outside the end surface.

The prior art inventions relate to a controlled or a non-controlled brake-/tension-generating unit for a thread-storing member, preferably a yarn feeder on a textile machine, for example a weaving machine, and can in this respect be of the type comprising two surface-supporting parts which can be placed opposite each other and which can be mutually influenced in directions towards and away from each other and between which a thread part running out from the thread store of the thread-storing member is passed during the thread drawing-off from the said member. The first surface-supporting part is placed at or on the end surface of the thread-storing member and the second surface-supporting part is arranged on a unit situated outside the end surface.

It is necessary for the brake to be able to function appropriately even on rapidly operating textile machines. For example, in weaving machines of the gripper type, the pick frequency can be 600 picks/min. or more. In addition, the brake will have to be able to effect a braking function which varies during the very quick drawing-out of the yarn. For example, in the case of gripper machines, it is desirable for the brake members to be able to provide a sinusoidal variation of the clamping force, or a variation of the clamping force adapted to the machine function.

It is also important for the brake function to be arranged at parts of the yarn feeder where the yarn drawing-off function is not disturbed and where the brake member does not unduly add to the periphery of the yarn feeder. It should be possible to obtain an effective control of the yarn at the drawing-off area for the yarn.

The known brake members do not solve the above-mentioned problems. Brake members with eye-shaped parts which can be tightened and slackened are inexact on account of the fact that the tightening cannot be carried out uniformly around the whole periphery. The actuation of the known individual spring members with magnetic force which will give rise to the pressing of the spring members against the yarn when the latter passes under the spring members is too inexact and can only be used for purely so-called on-off functioning.

There is therefore a requirement to produce a pressing function (braking function) against the yarn, which function is varied during each drawing-off process of the yarn. There is also a requirement that it should be possible for the varied pressing function to be effected during rapid yarn drawing-off processes, and in this respect it may be mentioned that textile machines, for example gripper machines, can operate at high pick frequencies, for example 600 picks/min. or higher. The output yarn brakes known hitherto operate essentially with purely on-off functions, which may be suitable if the only requirement is to achieve braking during part of the drawing-out process, for example in the final part thereof. The importance of the requirement of obtaining a instantaneously varied braking function during the drawing-off process, for example sinusoidal variations of the pressing force, has not to data been appreciated.

It is a complicated technical problem to achieve a suitable braking or yarn-tensioning function which takes into account with sufficient accuracy the acceleration and deceleration processes which occur during the drawing-off of the yarn. The problem becomes greater with increasing speeds of the machines used. Yarn speeds of up to 30 m/s (6,000 rpm) may be encountered in the machines of today and of the near future. Brake arrangement functions which can adapt to such rapid drawing-off processes must be able to operate at brake movement frequencies of between 20 and 200 Hz.

The choice of diameter of the surface-supporting parts in relation to the diameter of the thread store can vary. The weight (mass) of the components forming part of the output brake certainly increases when the diameter of the surface-supporting parts does not deviate substantially from the diameter of the thread-storing member.

It is therefore important to make the brake function more effective at the output side of a thread-storing member. The arrangements concern, inter alia, effective methods and means for effecting a varied brake function/thread-tensioning function during one and the same draw-off, for example one and the same pick in a weaving machine.

It is also important, in equipment of this type, for thread-braking/thread-tensioning generators with different functions to be made available. In this respect, it will be possible in principle for the brakes to have the same basic construction, but it will be possible for them to be designed for manual setting of the brake/thread-tensioning value which in this respect will be able to be kept constant (non-controlled) during a predetermined use period/operation. Furthermore, it will be possible for the setting to be carried out by purely manual means and/or by electrical means.

The present invention aims to solve these problems too and gives details of effectively operating brakes/thread-tensioning generators in which set values for the thread tensioning can be maintained, or alternatively variations can be effected during the same thread draw-off in a rapid and effective manner. The new construction also makes it possible to arrange brakes in which the brake surfaces can be kept free of (textile) lint and the like as a result of the "rotating" movements of the thread in the brake during the draw-off from the thread-storing member. The surface-supporting parts can also be designed with braking or clamping surfaces which provide effective cooling during the thread drawing-off process.

To be more specific than the above, one embodiment of the invention may involve the surface-supporting parts having external diameters which are substantially reduced, for example 10–40% of the external diameter of the thread storing (from which drawing-off takes place).

In further embodiments of the concept of the present invention, further details are given regarding the construction of the brake unit. An important point in this respect is that it will be possible for low-weight brake members to be used.

There is a requirement for a superactive brake/yarn-tensioning arrangement which can react instantaneously to the passage of a knot or other irregularity where it is a question of yielding immediately to the knot/irregularity from an executed braking or tensioning function, so that a yarn break or inadmissibly high yarn tensioning, which may endanger the operation, does not occur. It will be possible for the arrangement to operate at times of the order of magnitude of milliseconds or less. The arrangement will also be able to return to its executed function (braking/tensioning) immediately after the passage within or after the said time period. In the case of controlled braking, the control will be able to take place during the same machine stroke or equivalent. A superactive brake/tensioning arrangement is necessary in this respect. Activation, i.e. engagement and disengagement, increase/decrease, etc., will be able to be effected within the time interval 0.1–1.0 ms, which presupposes quick and light mechanical systems and components.

The present invention aims, inter alia, to solve the problems mentioned above, and the features which may be regarded as characterizing the invention are the fact that the members mentioned in the introduction are designed so as to effect a yarn-cleaning function, dependent on yarn rotation upon drawing-off, while simultaneously preventing considerable accumulation of material to be cleaned (lint, particles, etc.) in respect of the members (9, 15), and the fact that a mobility obtained by means of the component and weight choice for the member(s), bearing(s) etc., and preferably by means of considerably reducing the size of the external dimension of the first member, provides an instantaneous (for example 0.1–1.0 ms) yield and instantaneous (for example 0.1–1.0 ms) return to the previous braking/tensioning in the event of an irregularity/knot occurring on the, even rapidly, passing yarn and/or an instantaneous response to one or more controls for modifying the braking or tensioning force of the system during one and the same yarn drawing-off (machine cycle stroke) from the body.

In one embodiment, a clamping member is arranged to operate in the extension of the longitudinal center axis of the storing body and effects its clamping action by means of an actuation surface/actuation part whose cross-sectional area is considerably reduced in relation to the cross-sectional area of the storing body at its yarn-storing peripheral surface. Another feature in this respect may be that the counterstay surface/counterstay edge has an external diameter which is considerably reduced in relation to the diameter of the storing body at the yarn-supporting part. In a preferred embodiment, the external diameter of the counterstay surface/counterstay edge is about 50% or less of the said diameter of the storing body. In certain embodiments, it is also important to keep the external diameter of the clamping member low, and in one embodiment the maximum external diameter is about 50% or less of the said diameter of the bearing body. In one embodiment, the control unit and the clamping unit are arranged in order to allow the clamping member to effect a variation of the clamping force during the drawing-off process. In one embodiment, the variation is sinusoidal or a variation is provided which is adapted to the machine function for the machine on which the yarn feeder in question is used.

The actuation part of the clamping member can be designed with an actuation surface which is annular and forms an unbroken annular part or consist of a number of elements which are arranged close to each other and which together form a broken annular part. In one embodiment, the clamping member can form part of or be connected to a hollow cylindrical-shaped or essentially funnel-shaped part whose recess constitutes or forms part of an outlet part for the yarn. In addition, the clamping member can be designed so as to be able to bear in resilient manner against the yarn and the counterstay surface/counterstay edge during the whole of or parts of the drawing-off turn of the yarn from the storing body. In the case where individual resilient elements are used, these come into operation one at a time and successively during the unwinding turn in order to carry out their respective clamping functions. The clamping member can constitute, form part of or be connected to a movable actuation unit which is able to effect the variable function during rapid drawing-off processes, for example drawing-off processes of about 50–100 ms.

In the case where the funnel-shaped clamping member consists of a number of resilient elements which are arranged at the front/wider end of the funnel, the elements are preferably secured on the edge of the funnel, on the inside, or in the vicinity of the edge of the funnel. In this case, the free parts of the resilient elements extend towards the center of the clamping member where they press the yarn against a preferably outwardly curving counterstay surface which is situated on a part of the storing body. The last-mentioned part can consist of a ring made of wear-resistant material, for example ceramic. The resilient elements can have the shape of laminae, "fingers", leaves, etc. At their first ends, the resilient elements are attached to or integrated with an annular part which forms a common part together with the elements. The annular part forms securing members which can be secured in the hollow cylindrical-shaped or funnel-shaped member. In the case of the funnel-shaped member, the cone-shaped part of the funnel can consist of one or more resilient elements which, in the clamping function, are pressed against the yarn and the counterstay surface/counterstay edge. The last-mentioned surface or edge can in turn be arranged on a part arranged on the storing body. This can be either rigidly arranged in the storing body or displaceably/resiliently arranged in the same. In a further exemplary embodiment, the part in question is moreover resilient in itself. In the case of a tubular displaceable/resilient part in the storing body, the displaceable resilient part is mounted in a storing housing arranged in the storing body. In the storing housing, the displaceable/resilient part can be pressed in counter to the action of a first spring member. The storing housing and the displaceable/resilient part are adjustable in order to permit adjustment of the spring force obtained from the first spring member. In order to obtain the said adjustment, the storing housing is arranged rotatably in the storing body. The first spring member is arranged between an inner support member and an inner surface of the displaceable or resilient part. The support member can in turn be displaceable in the longitudinal direction of the storing body, and the displacement can be effected with the aid of rotational movements of the storing housing.

In one embodiment, the clamping member and/or the resilient element/resilient elements is/are displaceable relative to the storing body/part by means of a control unit which operates by means of electrical energy or gas and/or liquid media. In the case of a number of controllable resilient elements, these can be controlled individually or in unison. In the case of individually controllable elements, these can be allocated controls which give simultaneous clamping forces of essentially the same magnitude and/or clamping forces which vary gradually along the periphery of the unwinding turn. The activation of the resilient elements can be seen as a pulsating actuation function moving around the periphery. This actuation function can be arranged in coordination and asynchronously or synchronously with the yarn drawing-off/yarn drawing-off function. The actuation function can thus operate keeping ahead or trailing behind in relation to the yarn drawing-off function.

In one embodiment with a funnel-shaped clamping member with resilient elements in the cone-shaped part, the latter is connected to or integrated with a yarn carrier tube which extends through a coil. The relative longitudinal displacement movements of the funnel-shaped member in relation to the storing body are effected with the aid of electrical control signals applied to the coil. In this case, a second spring member is used which acts on the outside of the cone-shaped part and is designed to serve as a return spring for the modulation movements of the clamping member generated by means of the electrical control signals.

The longitudinally displaceable clamping member is arranged with an adjustment member by means of which the initial position of the clamping member can be adjusted relative to the storing body. The adjustment member can be manually or automatically actuated. In one embodiment, bellows members are used, and individual resilient elements can be arranged in association with the said bellows members. In a first embodiment, the resilient elements are secured to or in the bellows members at their first ends, in order to be able to drag against the yarn with their free parts and to press the yarn against the storing body or the part related to the latter. In one embodiment, the bellows members can be arranged on a wall or equivalent unit (disc-shaped part) which centrally supports the outlet part. The latter is thus separated from the clamping member. The wall or equivalent part can be adjusted relative to the storing body in order to obtain an initial position.

In the case of a displaceably/resiliently arranged part in the storing body, the said displaceable or resilient part can comprise a hood-shaped member. The latter can comprise an outer annular flange projecting from the member and of comparatively small diameter. The clamping member works against the flange with an actuating surface of correspondingly small diameter. The hood can comprise a projecting flange which serves as a stop member in the bearing of the part in the storing body. A small mass is of importance for the clamping member, and a mass of, for example, at most about 20 grams is used for the movable part in the clamping member. The secure clamping forces may be of the order of magnitude of 0–200 cN.

In one embodiment, the invention can be regarded as being characterized, inter alia, by the fact that the resilient elements are arranged in such a way that they can be tilted about bearing points, from whose first sides there project one or more actuating parts actuable by the control unit for the tilting movements of the resilient elements, and from whose second sides the resilient elements project in order to produce the said pressing. As a supplement or alternative to these features, the invention can be regarded as being characterised by the fact that the resilient elements are actuable from the control unit with a control actuation function pulsating around the periphery of the storing body and synchronous or asynchronous with the unwinding function of the yarn.

In further developments of the inventive concept, it is proposed that the actuating part will consist of an annular element from whose inner edge or inside the resilient elements project. The annular element can in this case be disc-shaped and arranged edgeways in the element's own plane. The resilient elements extend from the annular element inwards towards the centre and at small angles in relation to the plane and/or small angles in their own plane. The annular element has recesses for the tilting function, and the recesses in question can be distributed uniformly along the periphery of the annular element.

The resilient elements can be arranged individually or in groups around the periphery and each resilient element or group of resilient elements is allocated its control unit part which effects an individual actuation of the element or group of elements. In this case, the control unit parts can be controlled by a selector member, for example a register member, which successively connects the control unit parts depending on the movement/function of the selector. In this way, the pulsating control actuation function is obtained. In the case of an asynchronous control actuation function, this can operate with trailing behind or lying slightly in advance of the drawing-off function. The control unit is arranged to give a varied control function so that the pressing force, during the drawing-off of the yarn, varies sinusoidally or exhibits a variation which is adapted to the textile machine (gripper machine) for which the yarn feeder is intended. The control unit can operate with electrical control functioning or with some form of control media, for example gas and/or liquid. In the case of gas and/or liquid, use is made of hose parts, bellows members which are arranged beside each other around the section in question. The hose parts, the bellows members etc. are activated by the control unit successively during the pulsating actuation function so that the activation of each spring element or group of spring elements is effected.

According to the invention, there may be cooperating brake units and a brake or detaining unit. The first brake unit has a small mass and acts against a counterstay surface or counterstay edge on or at the nose of the storing body or a part on or at the nose of the storing body. The first brake unit can in this case have a small external diameter (permits small mass). A second brake or detaining unit acts against a second counterstay surface or counterstay edge which can be situated at the large diameter of the storing body, i.e. at the yarn-supporting part. The first brake unit effects at least the principal yarn-tensioning characteristic for the yarn part running out from the first brake unit. The second brake or detaining unit is intended to serve as a preliminary braking which may be deactivated at the start of and during the major part of the drawing-off process. Alternatively, in this part of the drawing-off process, it can operate with a smaller basic braking, which makes only a small contribution to the yarn-tensioning characteristic. During the final part, the second unit will have a braking or detaining effect on the yarn, which prevents slackening of the yarn part between said first and second units. The prevention of slackening eliminates any unacceptable entangling and/or characteristic-affecting tendencies.

In different embodiments, the first and second units are physically separated or physically coordinated. In addition, they can be controlled individually or in coordination from one or more higher-ranking control units for one or more yarn feeders and/or the textile machine in question.

The invention in the form of a brake arrangement, which can be used on a yarn feeder with a storing body for yarn and which, during the drawing-off of the yarn, permits modified or varied brake functioning on the yarn, even during rapid drawing-off processes, can alternatively use a first and second brake unit (detaining unit) or only the second brake unit (detaining unit). In the last-mentioned case, the invention can be regarded as being characterized, inter alia, by the fact that the second brake unit consists of or comprises an annular member and, associated with this, one or more feather-, finger- or bristle-shaped elements which extend from the annular member and inwards, if appropriate slightly inclined in and/or in relation to the plane of the annular element, towards the centre of the annular member. In a preferred embodiment with an annular member and associated elements, the latter are preferably arranged displaceably in the longitudinal direction of the storing body in order to permit reduction or increase of the pressing force of the elements against a counterstay surface or counterstay edge situated on the storing body, and in this respect of the pressing of the elements against the yarn when the latter passes the respective elements and the second counterstay edge/counterstay surface. The said elements can be arranged per se displaceably in the annular member so that the variable pressing force occurs. This displacement can be obtained with the aid of actuation members, in the form of electromagnet functioning, bellows or hose member functioning which operates with media in the form of gas, liquid, etc., and so on.

In a further embodiment, the second brake unit can consist of one or more pole body members with one or more leaf- or wirespring-shaped elements which can be secured at their respective first ends on respective pole body members which are arranged separately or are physically connected to each other to form an annular unit around the second counterstay surface or counterstay edge. Each pole body member can have a concave inner surface directed towards the second counterstay surface or counterstay edge, at which inner surface each resilient element is arranged in such a way that, from its first secured end, it extends with its free part downwards over the second counterstay surface part or counterstay edge part in question, where the said free part forms a part which can cooperate directly with the yarn when the yarn passes the said free part during the drawing-off process. The free part can also be designed with an angled part which forms a stop member which, when the free part bears against the counterstay surface or counterstay edge, comes into cooperation with the latter via a recess. In the case with a number of pole body members, which in this case are preferably distributed uniformly around the second counterstay surface or counterstay edge, the pole body members can be controlled individually or jointly from the said control unit/control units. With the pole body member(s) deactivated, each leaf- or wirespring-shaped element effects a deceleration and/or stop/detaining function on the yarn, and with the pole body member(s) activated, there is an elimination or reduction of the deceleration function and the stopping or detaining function which may optionally follow it.

Each free part of each leaf- or wire-shaped element extends in an arch or curve over an allocated part of the second counterstay surface or counterstay edge. In this case the length of the element can substantially exceed the length of the associated concave surface and can, for example, be up to twice as long as this. Alternatively, the length of the element is substantially equal to the length of the concave surface of the pole body member. Each pole body member can have a rectangular, square or U-shaped cross-section, etc. The second brake or stop/detaining member comprises one or more bearing members arranged spaced over the second counterstay surface or counterstay edge for pin- or needle-shaped members which are designed to act in a radial direction or in a direction which is inclined in relation to the radial direction, seen in the cross-section of the storing body. The pins or the needles act in a direction towards and away from the second counterstay surface or counterstay edge. The said pin- or needle-shaped members assume a first position in which the yarn passing under the pins or the needles moves freely from the pins or the needles, and a second position in which the yarn moves only partially freely (is braked) or is stopped. The taking-up of the second position from the first position can be effected successively. The actuation from the first position to the second position, or vice versa, can take place counter to the action of a spring function or elasticity function in each needle or spring or in a spring member which acts on each needle and spring. Each needle and spring can therefore spring back from its respective actuation positions as soon as the actuation ceases. The mass in each pin and needle is very small, and the bearing can also be designed substantially friction-free. The pins or the needles can lie loosely in their bearings in their non-actuated positions, the result being that they do not exert any real effect on the yarn, but instead the latter can pass the pins/needles and, upon passing the respective pin/needle, can push the latter aside. Upon application of the actuation of the pins/needles, the latter are forced by the actuation force against the counterstay surface/counterstay edge and can exert their braking effect successively (gradually) or directly. The actuation members can consist of electromagnets, one or more hoses which operate with liquid or gas media, etc. The actuation of each needle or pin can be effected via resilient elements which provide the successive braking function. The pins/needles can be designed with head-shaped elements.

In a further embodiment, the second brake or detaining/stop member consists of a part which extends around the second counterstay surface or counterstay edge and can be deformed upon actuation, which can be produced, for example, by means of a piston member, magnet member, etc. Upon application of the actuation, two brake or stop parts occur between the second counterstay surface or counterstay edge and the deformable member. In a further embodiment, the second brake unit comprises one or more brake bands or brake wires which are positioned opposite associated parts of the counterstay surface or counterstay edge. The bearing points for the brake band parts or the brake wire parts can be actuated by means of motors effecting rapid rotational movements.

In one embodiment, the first brake member is provided with one or more rearwardly-extending finger- or wire-shaped elements. The ends of the latter extend over the second counterstay surface/counterstay edge where the ends are arranged, as a function of actuations, for example from one or more magnetic fields, to come into braking or detaining/stopping cooperation for the yarn with the second counterstay surface/counterstay edge.

The feature which can be regarded as characterising one embodiment of the invention is that the surface-supporting parts have external diameters or peripheries which are substantially reduced, for example 10–40%, in relation to the diameter of the thread store.

In further embodiments of the inventive concept, more details are given of the construction of the brake. An important fact in this respect is that it will be possible to use low-weight spring members. In the case of a manually adjustable brake, use is made of a unit which comprises a sleeve or a housing which contains a rotatable screw and a nut. The screw can be subjected to manual rotational movements and the nut is designed in such a way that, upon movements of the screw, the nut executes longitudinal displacement movements in relation to the first surface-supporting part. The nut can constitute a support member for a spring member arranged between the second surface-supporting unit and the support member. The pressing force, with which the first and second surface-supporting parts bear against each other, can therefore be determined with the aid of rotational adjustments of the screw. Said adjustments are advantageously carried out in such a way that thread tensions in the range 0–100 grams are obtained. In one embodiment, the nut can be provided with a guide member which prevents rotational movements of the nut when the screw is turned. The guide member can run in a slot in the sleeve or housing, and the slot and the support member can form indicating members for the longitudinal displacement position of the nut in the sleeve/housing. Said longitudinal displacement position therefore constitutes a measure of the pressing force between the first and second surface-supporting parts.

The brake can also comprise a rough adjustment, by virtue of the fact that the unit as a whole is designed so that it can be adjusted roughly in the direction towards and away from the first surface-supporting part.

In a further embodiment, use is made of a so-called controlled unit for brake/thread-tensioning generation which can operate with great speed and sensitivity and can, during one and the same thread draw-off, for example weft pick, vary the pressing force of the second surface-supporting part against the first surface-supporting part and thereby vary the thread tensioning. Said actuation unit operates with voice (loudspeaker) coil functioning which in a known manner comprises a magnet member arranged in an iron core. In addition, there is a coil which receives electrical controls and, as a function of these, executes longitudinal displacement movements. The coil is connected to a diaphragm-suspended hub, to which the second surface-supporting part is also connected. The movements of the coil can in this way be transmitted to the second surface-supporting part as a function of said electrical controls. The unit comprises a bearing tube for the second surface-supporting part. The tube is suspended in one or more diaphragms. In one embodiment, the first surface-supporting part is arranged in said frame. Alternatively, the part can form part of said frame. Both surface-supporting parts have the shapes of a disc/plate having a straight and a curved section. The discs can be made to bear against each other at said straight sections, and the curved sections together form a large receiving opening for the incoming thread part.

In one embodiment, the first surface-supporting part is arranged in the thread-storing drum in the thread-storing member. Alternatively, the part can form part of, i.e. constitute an integrated part of the said drum. Both surface-supporting parts can have the shape of a disc/plate having a straight and a curved section. The discs in each part can be made to bear against each other via said straight sections, and the curved sections together form a suitable inlet opening for the incoming thread part.

In one embodiment, there is parallelism between the brake discs used. The brake acts by means of the brake discs exerting friction against the thread/yarn passing between them. In an embodiment intended to be able to produce a stable (constant) yarn tensioning, it is important that the pressure between the discs should be as constant as possible over the entire periphery of the brake. This necessitates a parallel and centered adjustment of the discs and their attachment. Since the number of intermediate/adjacent construction elements (for example the yarn feeder jib, in which the counter-brake disc is arranged) in the thread-storing member/yarn feeder is high, there is from the point of view of manufacturing and assembly a complicated problem which has hitherto been difficult to solve.

In a further embodiment, it is proposed to arrange a cavity for drawing the thread/yarn through the brake.

The problems mentioned above are solved in a technically simple but nevertheless satisfactorily functioning manner. The brake function can be integrated with the outlet channel part, which results in advantages from the point of view of construction. The diameter of the brake-effecting unit can be made small. The mass used upon braking can be made small, which is a precondition for rapid regulation of the clamping function and permits the desired rapid variation during the short drawing-out processes for the yarn.

By means of the invention it is possible to retain the advantages by using the rotational movement of the yarn upon drawing-off from the bearing body. Above all, the brake surfaces are effectively kept clean as a result of the sweeping movement. This provides large friction surfaces, which result in good cooling and wear-resistance. If the brake surface is designed as a finger-shaped brake surface, knots and irregularities in the yarn can easily pass without any great increase in tensioning, by virtue of the fact that it is only small masses which have to be lifted. By means of selecting the direction of the finger-shaped elements, it is possible to obtain easily a suitable yarn contact, with simultaneous cleaning by means of lint, particles etc. being transported off in the direction of the fingers. The resilient elements can be made light and of simple construction in order to permit, inter alia, replacement upon wearing and adaptation to different brake requirements. By using a longitudinally displaceable adjustment arrangement, it is possible to achieve a simple arrangement for adjusting the magnitude of the basic brake action, and the adjustment arrangement can also be designed such that brake element replacement, threading etc. are facilitated. The brake elements can be arranged such that a movement can be permitted for any eccentricity in the attachment and the storing body suspension. In the cylindrical yarn outlet part is secured the movable part of the manoeuvring unit, which can have the shape either of a coil or permanent magnet. Around the movable part the magnet coil or the permanent magnet is attached. By means of the electrical control arrangement, the manoeuvring cone can be displaced in the axial direction and exert a force against the coil body which, for the yarn, produces a clamping force between the brake element and the wear ring of the coil body cone. The bellows members in question can operate with air pressure in the bellows, which presses the brake elements against the wear surface of the storing body cone and produces an increased clamping force/brake effect. A control eye placed in the attachment can be used, and the risk of lint accumulation can be eliminated by using a control cone arranged between bellows and brake element.

By means of the measures suggested above, a yarn brake can moreover be built with the desired yarn-braking function.

The control by means of the control unit can be carried out in a manner known per se, and the desired variation of the yarn-actuation can be built in from the control point of view and from the mechanical or electromagnetic point of view.

A coil which thus acts essentially on the cylindrical part of the storing body can conceivably be designed in such a way that a utilised brake collar flange can be designed to be acted upon by, for example, one or more pneumatic elements. Each joint can be designed, for example, simply by punching out holes or slots in the brake collar, which holes or slots can be passed over pins or tips in the suspension ring over the peripheral surface of the storing body of the yarn feeder. The ring or the member which is arranged over the peripheral surface of the yarn-storing part is preferably designed as a closed channel which can comprise one or more air hoses or equivalent. The ring or the unit bearing the air hose is preferably arranged adjustably in the longitudinal direction of the bearing part in order to permit basic tensioning and opening for threading of the yarn between the brake elements.

The finger-shaped brake surface means that knots and irregularities in the yarn can pass more easily, without any great increase in tensioning, by virtue of the fact that it is only small masses which have to be lifted. By using finger-shaped brake diaphragms, the direction of the fingers can be adapted for suitable yarn contact, and cleaning takes place easily by means of lint etc. being transported off in the direction of the fingers. The brake elements are light and can be designed for easy replacement upon wearing and adaptation to different brake requirements. By using a bearing housing for hose parts, the hose can be divided up into a number of partial hoses which are activated successively in a sequence determined by a control unit, the result being that the desired pulsating actuation can be achieved.

A brake function operating for different application cases can be obtained. It is also possible, for example, to use two brakes which are controlled in relation to each other in such a way that a slight preliminary braking is obtained for the brake which effects the actual braking, in which respect it is ensured that the yarn part between utilised brakes is at all times tensioned. The preliminary braking can alternatively consist of a constant light braking, and this can be obtained in different ways according to the invention. At high yarn speeds, the fixed preliminary braking can be replaced by a variable light braking.

At, for example, 75% of the diameter D in question, the particularly important advantage remains that the brake surfaces are at all times kept effectively clear of lint and the like during the thread drawing-off as a result of the "rotating" movement of the thread or yarn in the brake when using the structural design which, independently of chosen diameter relationships, can perhaps be best described or defined as the output brake consisting of a plate brake arranged at the drawing-off end of the thread-storing member, transverse to the direction of linear movement of the thread, in which the second plate in the plate brake (=the second surface-supporting part) cooperates with the first plate, or alternatively directly with the end surface of the yarn-storing member (=the first surface-supporting part) for clamping of the thread or the yarn which, during its drawing-off from the yarn-storing member, runs radially inwards towards the centre of the "plate brake", in which respect this radial entry on account of the drawing-off movement constantly migrates clockwise or anticlockwise (depending on the direction of drawing-off) in the brake, and where the thread or the yarn thereafter runs out from the brake and away from the yarn-storing member through a passage in the centre of the second plate (=the second surface-supporting part).

BRIEF DESCRIPTION OF THE DRAWINGS

A presently proposed embodiment of an output yarn brake which exhibits the features characteristic of the invention will be described hereinbelow with reference to the attached drawings, in which.

DETAILED DESCRIPTION

Figure 1:
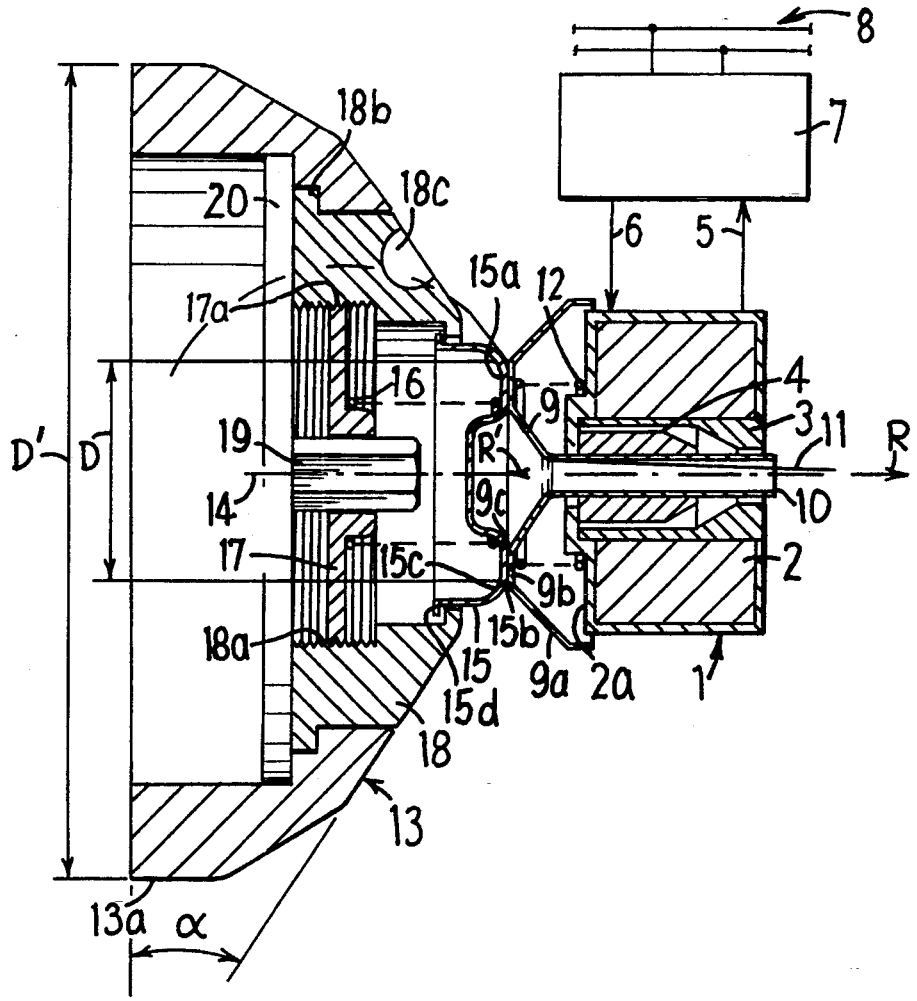
FIG. 1 shows, in longitudinal section, rear parts of a yarn-storing body incorporated in a yarn feeder, and an output yarn brake arranged at said rear parts.

In the exemplary embodiment according to FIG. 1, use is made of an electromagnetic control in which an electromagnet has been designated 1. The electromagnet comprises a winding 2, a coil former 3 and an iron core 4. Connections 5, 6 connect the electromagnet to a control unit 7 which can be of a known type. The control unit in turn receives controls (for example from higher ranking control members/control arrangements) via a communication channel 8. The electromagnet bears in its central part a funnel-shaped member which is made up of a cone-shaped part 9 and a cylinder-shaped part 10 serving as carrier tube for a yarn 11. The cone-shaped member 9 can be resilient in itself and is provided with a backward-turned part or flange 9*a*. Between a front surface 2*a* of the coil former 3 and an inner surface 9*b* of the cone-shaped part there is arranged a first spring member 12 which abuts said inner surface and acts as a return spring for the funnel-shaped member. A modulation signal i from the control unit 7 causes a movement in the direction of the arrow R in the funnel-shaped member. The movement is proportional to the magnitude of the signal i. The return spring returns the funnel-shaped member in the direction of the arrow R′ when the signal decreases or falls below a previously determined value, etc.

The storing body of the yarn feeder or yarn feeding device is shown by 13, and the yarn is drawn off in a known manner from the storing body's storing surface 13*a* for a yarn 11. The storing body is designed with a part 15 which is resilient or movable along the longitudinal direction of the center axis 14 of the body. The part can be hood-shaped or cup-like and provided with a rearward-projecting flange 15*a*, against whose end surface 15*b* there acts a front surface 9*c* of the funnel-shaped member. The part 15 can be acted upon in the direction of the arrow R′ counter to the action of a second spring member 16 which is placed between a support member 17 and an inner surface 15*c* of the part 15. The last-mentioned part, the spring 16 and the support member 17 are arranged in a storing housing 18 which is borne rotatably in the storing body frame 13. The support member 17 is designed rotationally fixed by means of a hexagon column 19 secured in an internal fixed part 20. The storing housing 18 has an internal screwthread 18*a* and the support member 17 has a corresponding external screwthread 17*a* which is in engagement with the internal screwthread. In addition, the support member is longitudinally displaceable in the longitudinal direction of the column 19, i.e. along the center axis 14. When the storing housing is turned, a longitudinal displacement movement of the support member 17 is therefore obtained, with the result that the spring force from the second spring member can be adjusted by means of turning of the storing housing. The storing housing is arranged longitudinally displaceably fixed in the storing body frame by means of flange 18*b*. The storing housing has a key grip 18*c* on an output surface thereof for facilitating turning of the storing housing. The hood-shaped member 15 is designed with a stop flange 15*d* which provides a defined end position for the part 15.

The pressing or clamping about the yarn between the surfaces 9*c* and 15*b* can be varied by means of the control from the control unit 7 and the higher ranking control members via the communication channel 8. The basic position setting between the brakes and the storing body/part 15 can also be arranged (see below) by the yarn brake additionally being provided with adjustment members relative to the body 13. However, the said adjustment possibility for the second spring member 16 may be sufficient. The spring force for the part 15 can be adjusted in accordance with the above, and the surfaces 9*c* and 15*b* can therefore be made to clamp about the yarn with a selectable maximum clamping force. The yarn is thereafter controlled by means of the funnel-shaped member being drawn back in the direction of the arrow R with the aid of said control function. The force on the spring member 16 is also proportional as a function of the longitudinal displacement position of the part 15, which can be used in the clamping function. The external dimension (diameter) D is important for the invention and falls considerably below the diameter D′ of the storing body at the yarn-storing part. The diameter D will be about 50% of the diameter D′ or less. D is preferably chosen within the range 10–40% of the diameter D′. The surfaces 9*c* and 15 have clamping surface parts which are set at an angle or set transverse to the center line 14. The extent of these surfaces is chosen as a function of the diameter D′ and can be about 5% of the diameter D′. The storing body is in general of hollow cylindrical shape and the cross-sectional area for the bearing surface will be considerably less than the cross-sectional area for the spool body at the yarn-storing part. The first-mentioned cross-sectional area should be at most 50% of the last-mentioned cross-sectional area. Alternatively, the invention can be defined taking as a starting point the said diameters or cross-sectional areas. The clamping forces are of the order of magnitude of 0–200 cN, and the mass of the funnel-shaped member is small, for example 20 gram. The electrical control arrangement will be able to effect rapid controls of the clamping force during the yarn drawing-off process and the arrangement is adapted for this.

Figure 2:
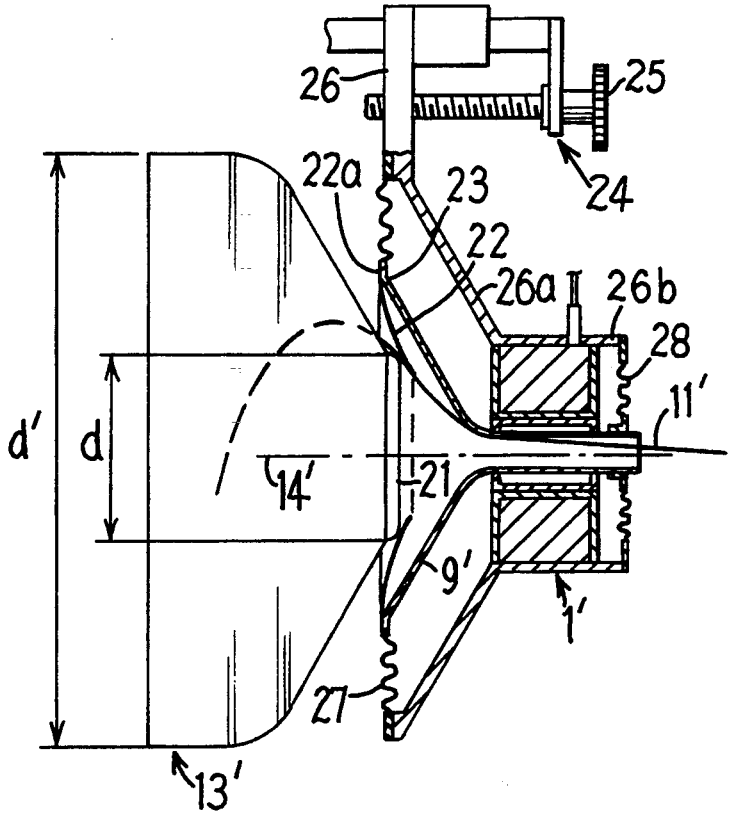
FIG. 2 shows, in partial longitudinal section, a second embodiment of an output yarn brake arranged at rear parts of a partially illustrated storing body of a yarn feeder.

FIG. 2 shows an example of electromagnet control acting against a fixed ring 21 on the storing body 13′. In this case, the cone-shaped part of the funnel-shaped member supports one or more resilient elements 22 at its outer edge 23. Each resilient element has the form of a "finger", a lamina, a leaf etc. and is secured at its first end 22*a* and presses with its free part against the yarn 11′ and the ring 21. An adjustment arrangement or assembly fixed in relation to the storing body is shown by 24. The electromagnet 1′ is securely suspended in a part or frame member 26 which can be acted upon by a screw 25 or equivalent member and which is displaceable as a function of the turning or actuation of the member 25 in the direction of the storing body 13′. The said part 26 comprises inclined parts 26*a* which extend at an angle or in cone formation rearwards to a housing 26*b* supporting the electromagnet. As return function for the controls by the electromagnet of the funnel-shaped member, use is made in this case of diaphragms 27, 28 at the front and rear parts of the funnel-shaped member. The diameters/cross-sectional areas for d, d′ are in relation to each other in accordance with the above. The spring elements 22 are preferably made up of a number of spring elements, of similar design as above, distributed uniformly along the cone-shaped part 9'. The longitudinal displacement control of the funnel-shaped member takes place in accordance with the above and the return movement by said diaphragms 27, 28. The arrangement of the springs in accordance with FIGS. 1 and 2 means that lint and particles on the yarn are led off in a functionally correct manner by means of the lint or particles migrating radially outwards.

Figure 3:
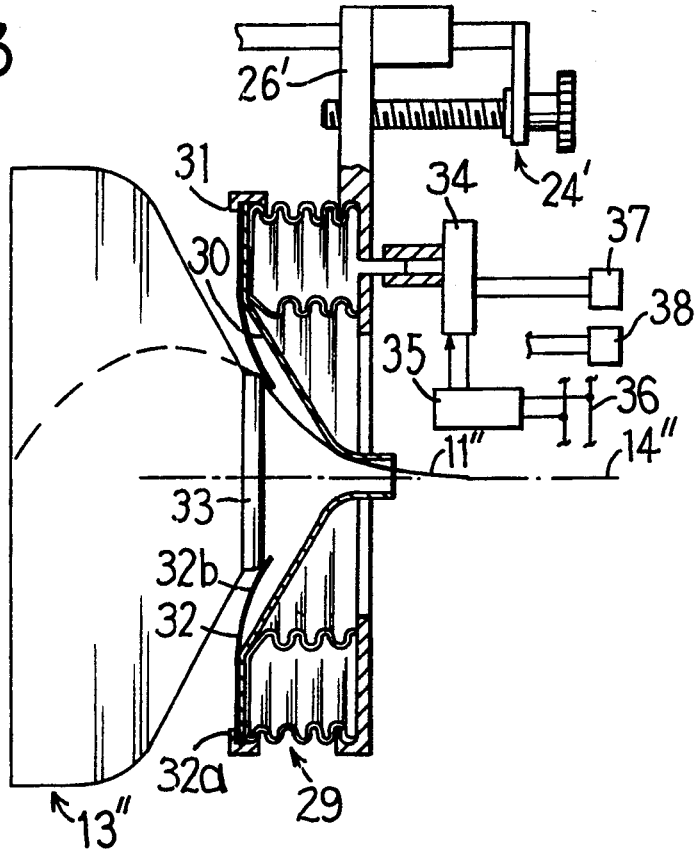
FIG. 3 shows, in longitudinal section, a third embodiment of a yarn brake arranged at rear parts of the storing body of a yarn feeder.

In FIG. 3 use is made of a bellows arrangement 29 of annular shape extending round the center axis 14''. The bellows member has at its front a cone-shaped depression or a part 30 which merges backwards into a cylindrical or annular outlet channel for the yarn 11'. The funnel-shaped recess through the bellows member is obtained with a part which is separate in relation to the bellows and which is fixed or secured at the front of the bellows. At the front 31 of the bellows there are additionally arranged spring elements 32 which are preferably several in number and are uniformly distributed around the periphery of the bellows. The elements 32 are securely fixed at their first ends **32*a* and with their free parts 32*b* press the yarn against a ring 33 made of wear-resistant material, for example ceramic (see the embodiment according to FIG. 2). The bearing force of the elements 32 can be determined by means of an adjustment member 24' (see the embodiment according to FIG. 2**) with which the bellows arrangement is basically adjusted in the longitudinal displacement direction of the storing body relative to the storing body.

The control function is effected by means of the quantity of media in the bellows being varied. The media variation is produced by means of a known valve member 34 which receives controls/control signals i' from a control unit 32 which in turn receives or can receive information via, or transmit information via, a communication channel/connection 35 with respect to a higher-ranking control member/control arrangement. A pressure source which can be connected to the inside of the bellows member by means of the valve member 34 is shown by 37, and an optionally used sump is shown by 38. As regards the control function, see the exemplary embodiment as above. The bellows arrangement is secured in the displaceable part 26' (see the part 26 in FIG. 2).

Figure 4:
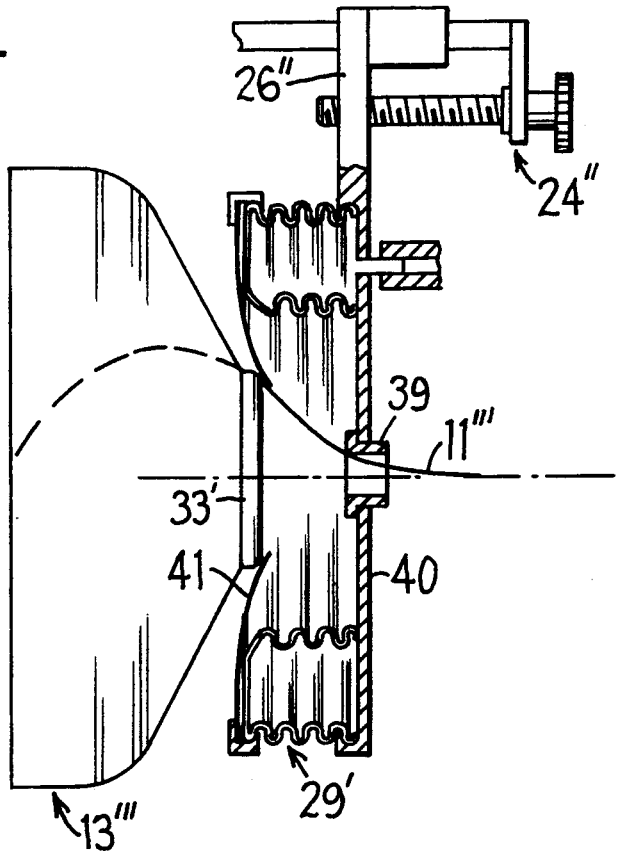
FIG. 4 shows, in longitudinal section, a fourth embodiment of a yarn brake arranged at rear parts of the storing body of a yarn feeder.

In the exemplary embodiment according to FIG. 4, the bellows member 29' and the outlet member 39 are separated. The outlet member is arranged in a rear plate 40, on whose front the annular bellows member is secured. One or more resilient elements of corresponding construction and attachment as above are arranged around the periphery. A wearing ring 33 (see above) is used as counterstay member on the storing body 13''. The rear plate 40 is secured in the part 26'' (see above) and the basic adjustment arrangement is designed as above.

As regards the said resilient elements 22, 32, 41, these are preferably arranged on an annular part, from whose inner edge the said resilient elements project inwards towards the centre of the annular part. The said annular part preferably has a disc shape, and the resilient elements can extend from the disc-shaped part in the same plane as the disc-shaped part or slightly at an angle in relation to the plane of the disc-shaped part. Alternatively or in addition, the resilient elements can be slightly inclined in the plane of the disc-shaped part so that they extend towards points which are situated slightly to the side of the centre of the annular part.

In accordance with a preferred embodiment, the storing body 13 is designed with a cone-shaped finish, at which the counterstay surface is arranged. An angle $\alpha$ (see FIG. 1) between the base of the cone and the side surface is about 30° and is chosen preferably between 40°–50°.

Figure 5:
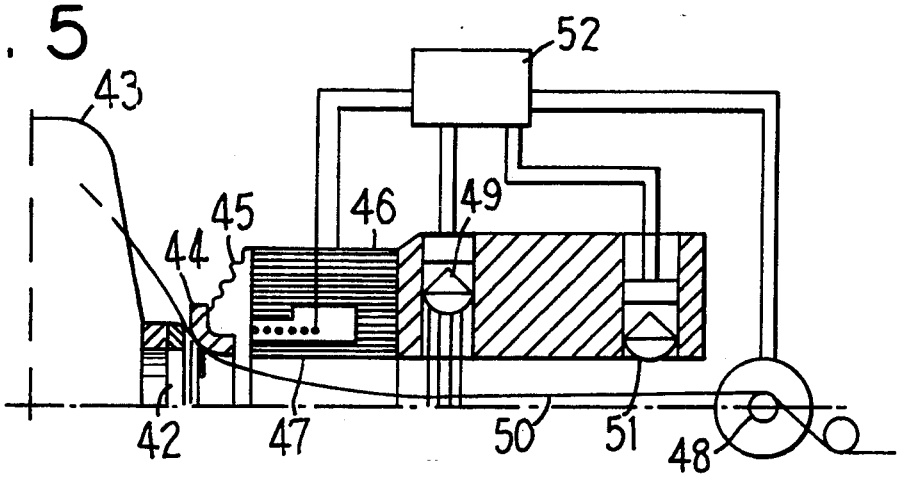
FIG. 5 shows a fifth embodiment having a heat producing member for heat marking the yarn.
Figure 5A:
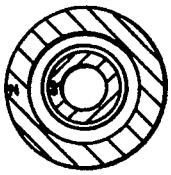
FIGS. 5*a*–5*f* show various details of an end view of the electromagnet, the clamping surface configurations, and the electromagnetic structure for the yarn brake.
Figure 5B:
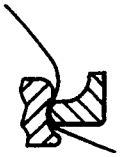
Figure 5C:
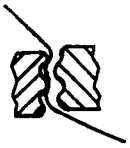
Figure 5D:
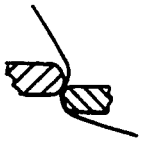
Figure 5E:
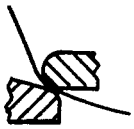
Figure 5F:
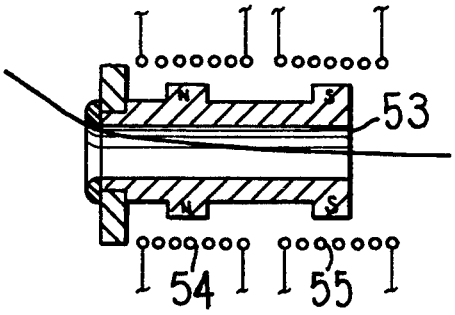

FIG. 5 shows a fifth embodiment of the invention which can function together with the stated features or in isolation. A wearing ring 42 is arranged on the body 43 and is designed with an L-shaped cross-section and is resiliently suspended in the brake member body by diaphragm 45. The control unit comprises or controls an electromagnet 46 which has a winding 47. A mechanical (known) tensioning brake for the yarn tensioning is shown by 48. A heat-producing member 49 (laser diode, microwave source etc.) is designed to heat-mark the yarn 50. A receiver 51 (IR detector) detects the marking. A control unit 52 is connected via lines to said members and can feed back yarn tensioning and/or yarn speed to the control member 46 (or give this member a feed-back dependent on the tensioning or speed) which effects the clamping function dependent on the detection such that the yarn braking is controlled sinusoidally or in another form. Alternatively or in addition, the control unit can detect the machine angle. FIG. **5*a* shows the electromagnet from the end. FIGS. 5*b*–5*e* show different configurations of the cooperating surfaces of the clamping and counterstay members, which cooperating surfaces provide different deflection functions for additive brake functioning. FIG. 5*f* shows an exemplary embodiment with a hollow cylindrical member 53 with north and south poles and two winding/actuation coils 54, 55 designed to produce to and fro movements of the member 53, with the result that mechanical return springs are not necessary. As a result of the small diameters of the clamping and counterstay members 42, 44**, low tangential unwinding speeds are obtained at the nose cone of the storing body, and also good yarn control in the drawing-off area.

Figure 6:
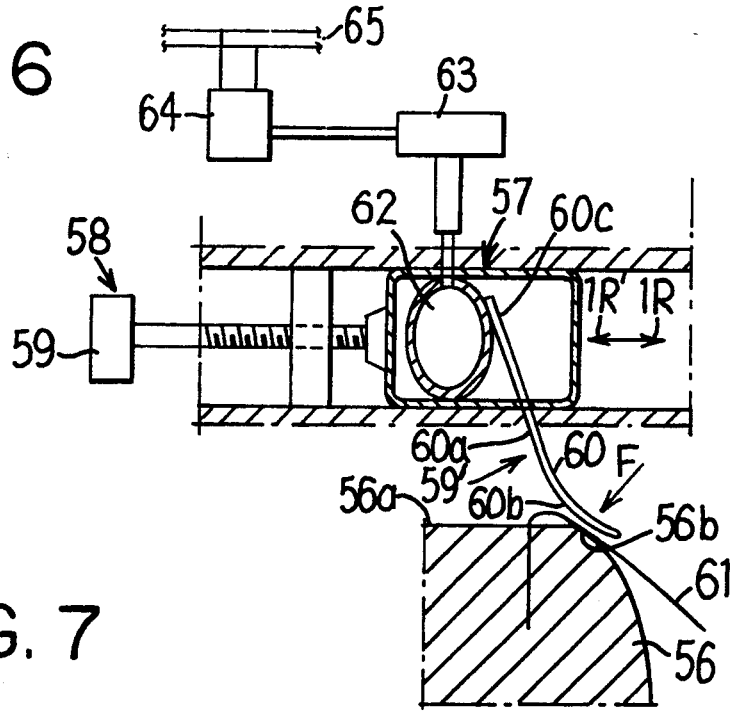
FIG. 6 shows, schematically in longitudinal section, the function of the brake member and its application in connection with a storing part for a yarn feeder.

In FIG. 6, a storing body incorporated in yarn feeder is shown by 56. An annular bearing housing 57 is arranged around the periphery **1*a* of the storing body. The bearing housing 57 is arranged displaceable relative to the storing body with longitudinal displacement member 58. Such a member can consist of a screw 59, upon whose turning the housing 57 is longitudinally displaceable in the direction of the arrows 1R and 1R'. Brake members 59 are arranged in the bearing housing. The brake members comprise resilient elements 60 which are secured at their first ends 60*a* and extend with their free parts 60*b* down towards a counterstay edge 56*b* or counterstay surface of the storing body 56. The yarn 61 passes between said free ends and the counterstay edge 56*b* or counterstay surface, and the resilient elements effect a pressing force against the yarn and the edge/surface which is dependent on the elasticity of the elements and the longitudinal displacement position of the bearing housing relative to the storing body. Upon displacement of the bearing housing to the left in the direction of the arrow 1R', the force F increases, and upon displacement in the direction of the arrow 1R**, the force decreases.

The elements 60 have individual or a common actuation part(s) **60*c* arranged in said bearing housing. The actuation part(s) 60*c* and the resilient elements together form a common unit in which the actuation part forms an annular part or sector-shaped parts around the bearing housing. Each actuation part consists of a disc-shaped part which is arranged edgeways and from whose inner edge the resilient elements 60 project. The actuation part is mounted tiltably in the bearing housing 57 and can be acted upon for its tilting movements by means of an actuating member 62 which in the present case has the form of an air hose or air hose parts. Alternative embodiments of the actuating members can be electromagnets, bellows members etc. When the hose expands, the annular part(s) 60***c* tilt(s) about its bearing point/their bearing points, with the result that the free parts of the resilient elements are forced against the counterstay surface 56*b* and the pressing force F against the latter is increased. The increase is dependent on the expansion of the hose. Air (or another media: gas and/or liquid) coming to the inside of the hose can be controlled by means of a known valve member 63 which in turn receives controls from a known control unit 64. The latter can be connected to a communication 65 which leads to or from a higher-ranking control member/control arrangement. Upon emptying or discharging of media from the hose, the disc-shaped part is returned/tilted back by the counterforce on the resilient elements from the counterstay edge.

Figure 7:
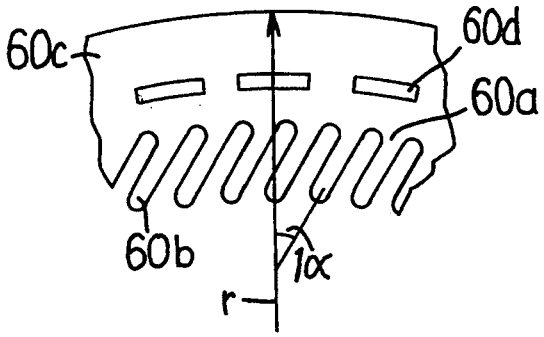
FIG. 7 shows, in an end view, parts of the construction of the brake member.
Figure 8:
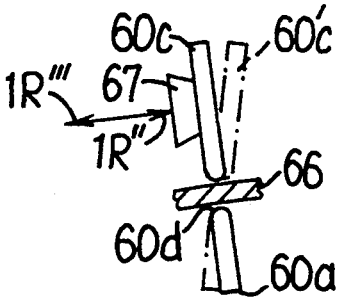
FIG. 8 shows the tilt suspension of the brake members, enlarged in comparison with FIG. 6.

According to FIG. 7, the annular part (actuation part) 60*c* is provided with recesses 60*d* for the tilt bearing. The resilient elements are inclined in relation to a radius r at angles 1$\alpha$ which can be chosen preferably between 5° and 30°. The elements 60*b* can also be angled in relation to the plane of the annular part 60*c* at smaller angles (not shown). In FIG. 8, a pin which is arranged in the bearing housing and is intended to extend through a bearing recess 60*d* is shown by 66. Two tilt positions are shown, on the one hand the position shown by full lines 60*c*, and on the other hand the position shown by broken lines 60*c*'. A generally acting member is shown by 67 and the directions of actuation are shown by 1R" and 1R'". The resilient elements bear against the counterstay surface with force F, and the counterforce from the counterstay edge serves as a return force upon regulation from the control equipment 62, 63, 64.

Figure 9:
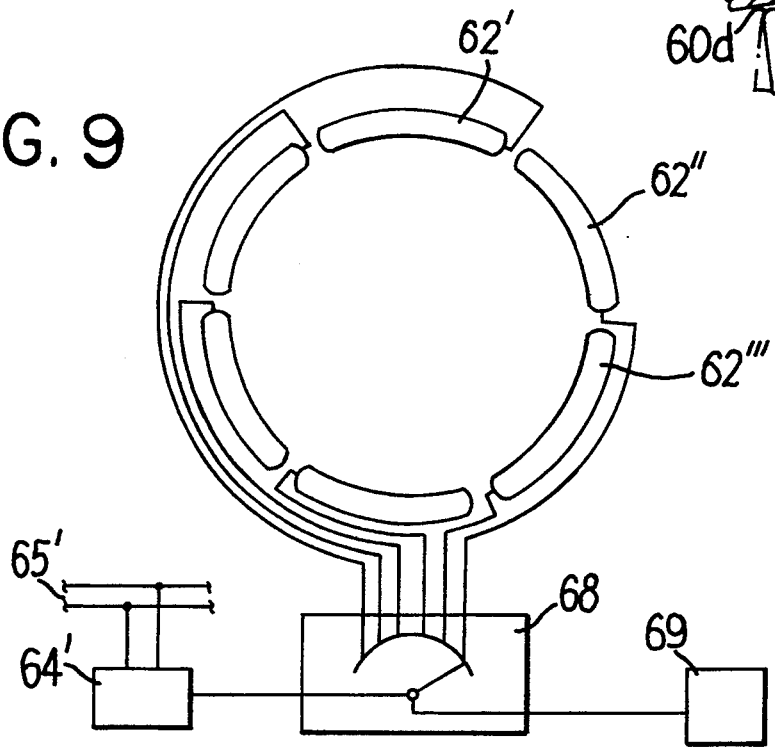
FIG. 9 shows, in basic circuit form, the control actuation of hose elements designed as actuation members for the brake members according to FIG. 6.

According to the invention, the actuation member 62 according to FIG. 9 can consist of a number of hose parts 62', 62", 62'" etc. which are distributed uniformly over the periphery and are activated successively by selector function/selector member 68 which connects the hose units one at a time to a power source 69. The controls can be effected by a control unit 64' which is connected to a higher-ranking control unit via a communication 65' (see above). The controls in this case can be arranged synchronous or asynchronous with the yarn drawing-off. In the asynchronous case, the phase displacement can lie ahead of or behind the drawing-off function for the yarn.

Figure 10:
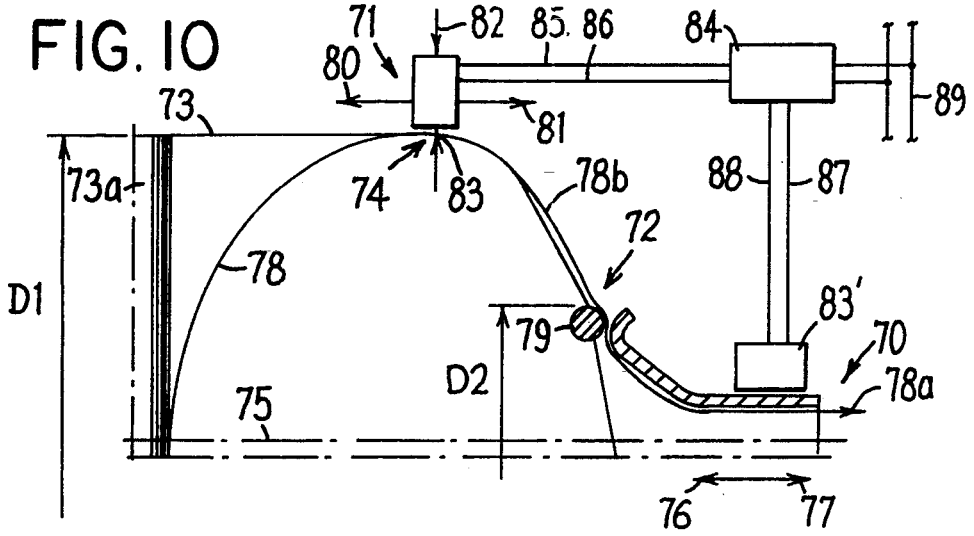
FIG. 10 shows in principle a longitudinal section of the brake arrangement comprising first and second brake members which cooperate with two different parts or points on the storing body of the yarn feeder.

In FIG. 10, a first brake member is shown schematically by 70 and a second brake member is shown schematically by 71. The first brake member acts against a nose part 72 on a storing body 73 which forms part of a yarn feeder which can be of a type known per se. The second brake member acts against a counterstay surface or counterstay edge 74. The first brake member is movably arranged in the direction of the centre axis 75 of the storing body. The directions of movement are indicated by arrows 76 and 77. The storing body 73 is provided with a yarn-storing part 73*a* which is designed with the full diameter D1 of the storing body. A yarn is indicated by 78, and the yarn has a drawing-off or running-out direction 78*a*. Upon drawing-off of the yarn, the latter passes the second brake member and the first brake member. According to the invention, the yarn part 78*b* will be controlled in the drawing-off area between the first and second brake members 70, 71. The first brake member is described in greater detail below and is characterised by a small mechanical mass which is arranged movably in directions towards and from a counterstay member, which can consist of a wearing ring recessed in the storing body material and consisting of wear-resistant material (for example ceramic). The counterstay member 79 is arranged in the storing body and is made of wear-resistant material (for example ceramic). The counterstay member has a diameter D2 which is small in comparison with the diameter D1. The second brake member is arranged preferably on a peripheral counterstay surface or counterstay edge 74 and has members which can cooperate with the running-out yarn but which are not shown in particular in FIG. 10. The second brake member is either movable in itself, in order thereby to permit movement of the members cooperating with the yarn, or bears movably the said members cooperating with the yarn. The first member effects the principal braking of the yarn, while the second brake member can be regarded as a preliminary brake or light brake whose main task it is to hold the yarn part 78*b* tensioned, particularly during the deceleration process of the member. In such deceleration processes, the second brake member has the task of preventing the yarn from slackening at the drawing-off point on account of its mass and movement, which slackening can cause entangling at the input of the first brake member and irregularities in the yarn-tensioning characteristic at the output of the first brake member. The second brake member/the members of the second brake member cooperating with the yarn can be movable in the longitudinal direction of the storing body 73 and/or in the transverse direction of the storing body. This movement function is symbolised by arrows 80, 81 and 82, 83. The first and second brake members can be controlled either individually or jointly. In the exemplary embodiment according to FIG. 10, there is a joint control. The first brake member has electromagnetic control with winding 83 which is connected to a common control unit 84, to which the control for the second brake member is also connected via lines 85, 86. The lines for the winding 83 are indicated by 87, 88. The control unit can in turn be connected to higher-ranking control units (not shown) via a communication connection 89.

Figure 11:
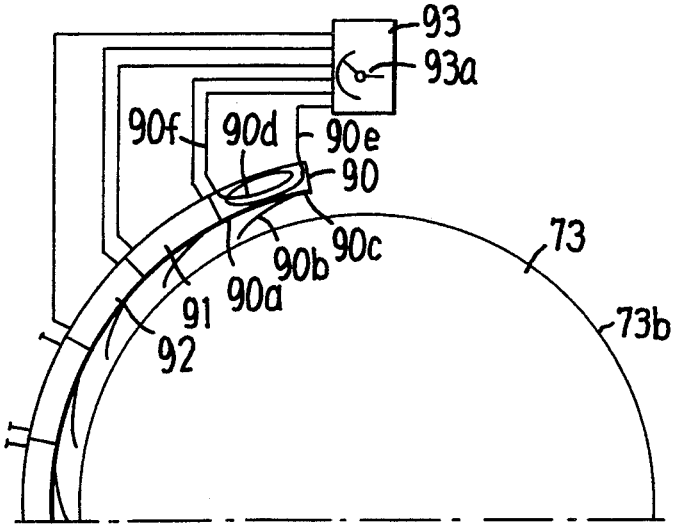
FIG. 11 shows schematically and in cross-section a first embodiment of a second brake member.

FIG. 11 shows an exemplary embodiment with pole body members 90, 91, 92 etc. arranged along the periphery 73*b* of the storing body 73. The pole body members in this case are of the type consisting of a pole body with a concave inner surface which is directed towards the peripheral surface 73*b*. Each pole body has a leaf- or wire-shaped element 90*b* which is secured at its first end 90*c* and which with its free part extends down over the peripheral surface 73*b*. The winding 90*d* of the pole body member is connected via connection lines 90*e* and 90*f* to a control unit 93 (see the control unit 84 in FIG. 10). The control unit 93 can comprise selector members which successively connect the pole body members arranged in a row one after the other.

These members can also be coupled-in in groups or jointly. The free part 90*b* of each element can be given a shape which optimises the yarn-braking and/or possible stopping of the yarn. One feature is that at least a part of the free part comes into cooperation with the yarn for the purpose of clamping thereof, which clamping can be varied during a drawing-off process. The leaf- or wire-shaped element assumes its sprung position when the pole body winding is not connected to any energy source. Upon connection to the energy source, the element (the free part) is attracted by the pole body member and the element leaves its position of cooperation with the yarn. The pole body members can be physically joined in accordance with FIG. 11. Alternatively, they can consist of separate units which are distributed uniformly along the peripheral surface 73*b*. One and the same pole body member can have several leaf- or wire-shaped elements. One and the same leaf- or wire-shaped element can be acted upon by one or more windings.

In the embodiment according to FIG. 11, the leaf- or wire-shaped elements have extensions which in principle correspond to the concave extensions of the inner surfaces of the pole body members. According to FIG. 12, each leaf-or wire-shaped element can have a different extension which is more closely associated with the peripheral surface 73*b*'. Thus, the element 90*b*' attached at the first end 90*c*' to the pole body member 90' can have an extension in which parts of the extension are associated with the shape of the peripheral surface 73*b*. The element can also be given a length (see the broken line 90*g*) which means that the element is longer than the concave-shaped inner surface 90*h*. The element can be designed to provide a successively increasing braking of an incoming yarn part 94 (see direction of arrow 95).

Figure 13:
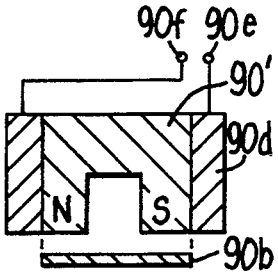
FIG. 13 shows in cross-section a first exemplary embodiment of the construction of the pole body.
Figure 14:
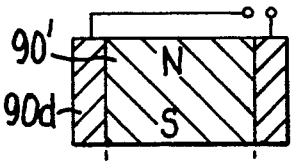
FIG. 14 shows in cross-section a second embodiment of the pole body member.

According to FIG. 13, the pole body member can have a U-shaped cross-section, or in accordance with FIG. 14 a rectangular cross-section. In the former case, poles (N and S) are formed at said legs, while in the case according to FIG. 14 the north and south poles are formed at upper and lower parts of the cross-section.

Figure 15:
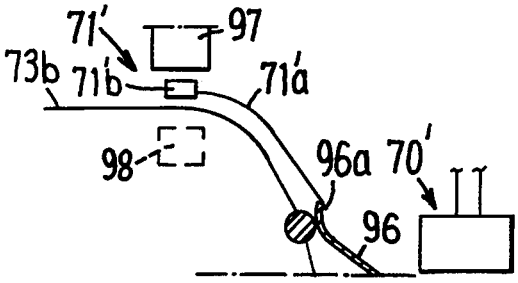
FIG. 15 shows schematically, and in longitudinal section, an example of a brake arrangement with the first and second brake members physically integrated.

FIG. 15 is intended to show the case in which the first and second brake members 70', 71' are physically joined. The first brake member has a funnel-shaped part 96, from whose end edge 96*a* finger- or leaf-shaped elements 71' a project and extend rearwards, these elements at their free ends supporting parts 71'*b* which are designed to be actuated by means of a magnetic field from an electromagnetic member 97 known per se. Upon activation of the electromagnetic member 97, the part 71'*b* is repelled towards the peripheral surface 73*b* in order to effect the clamping cooperation with the passing yarn part or firm locking of the yarn part (if this is desired). The second brake member can be designed with a number of such resilient elements 71'*a* which are distributed uniformly along the periphery 73*b*. The end parts 71'*b* can in principle be arranged in such a way that together they form a broken or unbroken ring around the periphery 73*b* when they assume the positions of cooperation with the yarn. In addition or as an alternative, the ends parts 90*b*' can be actuated by means of one or more electromagnetic members 98 arranged in the spool body.

Figure 12:
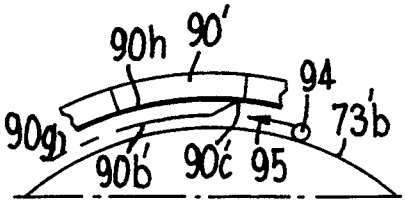
FIG. 12 shows schematically and in cross-section an alternative embodiment of a pole body with associated leaf spring.
Figure 16:
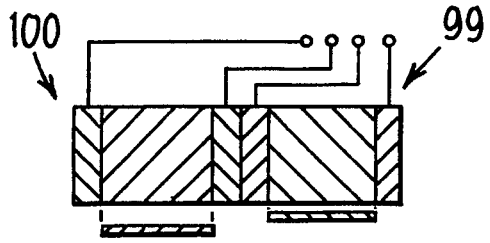
FIG. 16 shows in cross-section two pole body members which are arranged beside each other and which are mutually displaced in the peripheral direction of the storing body so that their leaf spring members will overlap each other in the peripheral direction.
Figure 17:
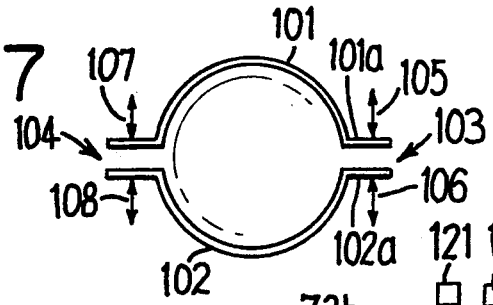
FIG. 17 shows schematically, and in an end view, a third embodiment of the second brake member.

In order to obtain a continuous coverage with the resilient elements on the pole body members according to FIGS. 11 and 12, it is possible according to FIG. 16 to arrange two pole body member rings or pole body member arrangements alongside each other and mutually offset in the peripheral direction. Each arrangement is symbolised by 99, 100 and each pole body member/pole body ring has in this case a square cross-section, although of course the cross-sections according to FIGS. 13 and 14 can also be used in this case. The controlling of the pole body members takes place in a similar manner as in FIG. 11. FIG. 17 shows an embodiment in which semicircular clamping belts 101 and 102 are used. The clamping belts are in principle separable, at least at their first bearing points 103, but they can also be separable at their other bearing points so that the movements according to arrow pairs 105, 106, 107 and 108 are obtained, it being possible for the actuation to be coordinated or individual.

Figure 18:
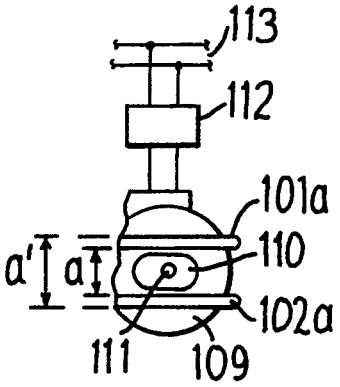
FIG. 18 shows, in an end view, components of the embodiment according to FIG. 8, which components effect separating and clamping movements for the second brake member.

FIG. 18 shows an example of how the flange pair 101*a*, 102*a* can be actuated by a motor 109 which has an oval actuation part 110 on its output shaft, which is symbolised by 111. In the position shown in FIG. 18, the flanges 101*a*, 102*a* assume a minimum spacing a, whereas, in a position of rotation of the oval part 110 by 90°, the flanges assume a mutual spacing a'. The motor consists of a fast motor which can be of a type known per se. Movement-enlarging members of a type known per se can also be used for movement/time unit. The motor is controlled by means of a control unit 112 which can be connected to higher-ranking control units (not shown) via a connection (see above).

Figure 19:
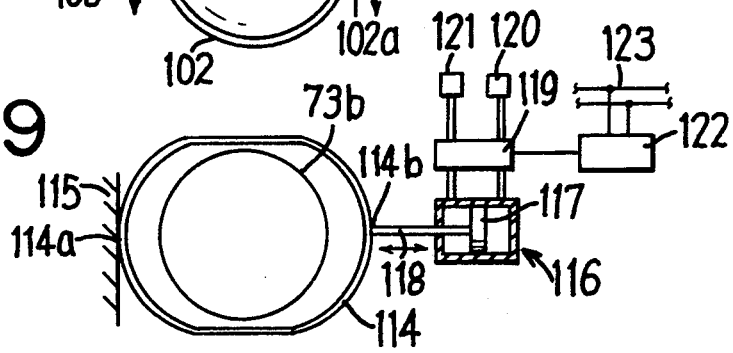
FIG. 19 shows a fourth embodiment of the second brake member.

FIG. 19 shows an embodiment with a deformable unit 114 which extends around the peripheral surface 73*b*. At a part 114*a*, the deformable unit is anchored on a frame part 115. At a point 114*b*, which is opposite the point 114*a*, an actuation member 116 is attached. The actuation member can consist of a piston 117 with piston rod 118 which is secured at point 114*b*. The piston can be controlled by media (gas and/or liquid) which can be coupled-in by means of a control valve 119 which connects pressure source 120 and sump 121 to both sides of the piston 117 alternately. The control valve 119 can be controlled by a control unit 122 in a known manner, which control unit can be connected to higher-ranking control units via a connection 123 (see above).

Figure 20:
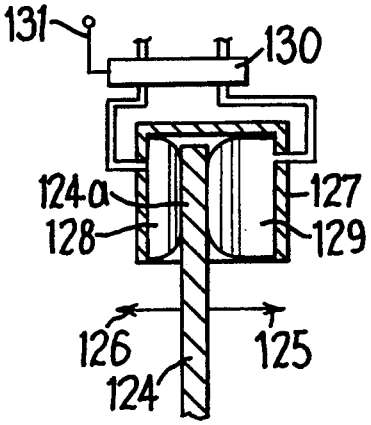
FIG. 20 shows a cross-section of a fifth embodiment of the second brake member.

FIG. 20 shows the case in which the second brake member comprises an element 124 displaceable in the longitudinal direction 125, 126 of the storing body in a frame 127 belonging to the second brake member. In the example shown, the control is effected by means of bellows, hoses or other members which vary their volume as a function of media supply, in which respect the media can consist of gas and/or liquid. The connection of the media source is carried out in a corresponding manner to FIG. 19, and the control can also be compared with the arrangement in FIG. 19. Thus, a control valve 130 can be used which is controllable from a control unit via one or more lines 131. The element 124 can be resilient at its parts projecting from the frame. The element comprises a part 124*a* acted upon by the members 128, 129.

Figure 21:
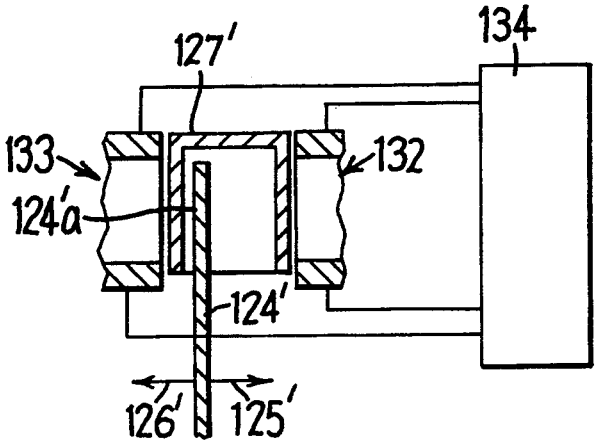
FIG. 21 shows in cross-section a sixth embodiment of the second brake member.

According to FIG. 21, the movement 125', 126' can be carried out alternatively with the aid of electromagnetic members 132, 133, which electromagnetic members are controlled via a control unit 134 (see above). The element is designed in a corresponding manner with a projecting part 124' which can cooperate with the yarn as a function of its longitudinal displacement position, and with a part 124*a*' which can be acted upon by the electromagnets 132, 133.

Figure 22:
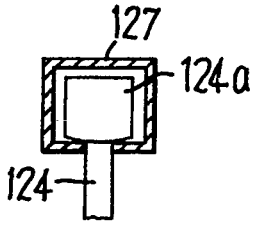
FIG. 22 shows a cross-section, which is at 90° relative to the cross-sections according to FIGS. 20 and 21, of the bearing for an element incorporated in FIGS. 20 and 21.

FIG. 22 shows the control of the element in the frame 127.

Figure 23:
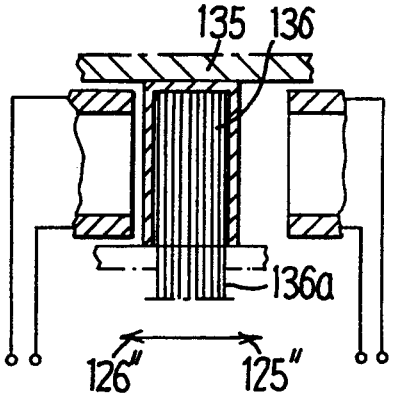
FIG. 23 shows a seventh embodiment of the second brake member.

In the exemplary embodiment according to FIG. 23, the frame 135 is displaceable in its entirety in directions 125'', 126''. In this case, the frame holds the elements 136 securely. These elements can consist of bristles, horsehair, etc. and can be resilient at their parts 136*a* projecting from the frame.

Figure 24:
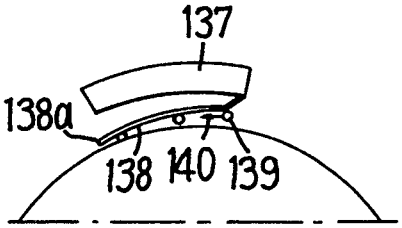
FIG. 24 shows a further embodiment of the pole body members according to FIGS. 11 and 12.

In one embodiment, the second brake member is designed in such a way that a successive braking takes place in the longitudinal direction of the brake member in order finally to be stopped completely by a stop member. This principle is shown in FIG. 24 and is effected with the aid of a pole body 137 with associated leaf- or wire-spring 138 (see above). The spring force and the actuation from the electromagnetic force are in this case designed such that an incoming yarn part 139 encounters an increasing resistance as it passes under the element in the direction of arrow 140. The element 139 is provided at its end with a downward-turned part 138*a* which forms a final stop member for the yarn part when this reaches the end position.

Figure 25:
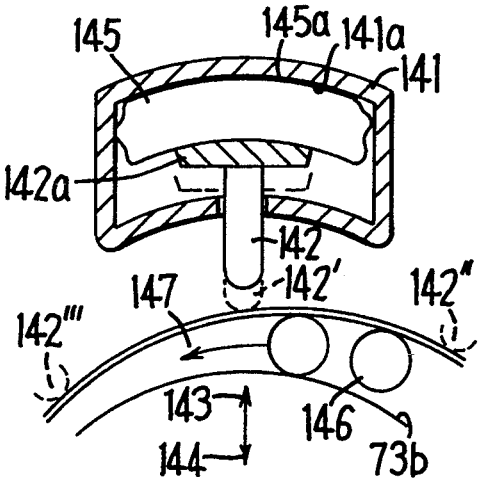
FIG. 25 shows an eighth embodiment of the second brake member.

FIG. 25 shows that the frame 141 of the second brake member can bear elements 142 in such a way that the latter execute, depending on the actuations, radial movements or movements which are inclined in relation to the purely radial direction, i.e. essentially radial movements. The elements can be pin- or needle-shaped or have another formation. The elements can be resilient or essentially rigid. In FIG. 25, an element is actuable in the directions of arrows 143, 144 which are essentially radial or inclined in relation to these radial directions. In the example, the actuation is carried out by a member which can effect volume expansions and volume reductions in relation to actuations. In the exemplary embodiment, the said member consists of a bellows or hose 145 which extends around all or part of the peripheral surface 73*b*. The bellows, the hose etc., is secured at its top surface 145*a* to an inner surface 141*a* of the frame. The pin-shaped element has, in the exemplary embodiment, a head-shaped part 142*a* which can be actuated by means of the hose, bellows 145. By introducing media and emptying the hose, bellows etc., the said essentially radial movements are obtained, and the end positions are shown by the full line 142 and broken line 142'. A number of such elements can be positioned alongside each other so that they cover the peripheral surface 73*b*. A group of elements can be arranged so as to be coordinated such that a successive slowing-down function (increasing slowing-down function) is obtained for the yarn 146. In the case shown, the element positions 142'', 142' and 142''' indicate, for a number of elements placed one after the other, different degrees of effect on the yarn 146, for which the braking function successively increases as the yarn moves in the direction of arrow 147.

Figure 26:
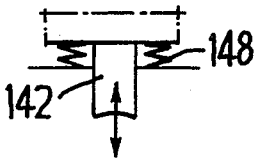
FIG. 26 shows a detail of the embodiment according to FIG. 25.
Figure 27:
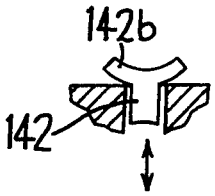
FIG. 27 shows a second embodiment of a detail in FIG. 25.

FIGS. 26 and 27 show that the actuation of the pin-shaped member can be effected counter to the action of a spring 148. FIG. 27 shows that the action can be effected counter to an elasticity built into the element 142, for example in the head 142*a* or in a flange 142*b*. The spring 148 or the elasticity in question means that the element returns quickly to its initial position (position of lesser interaction with the yarn or position of no interaction with the yarn) as soon as the actuation force ceases. The actuation of the said radially functioning pins, needles etc., can be effected as above.

Figure 28:
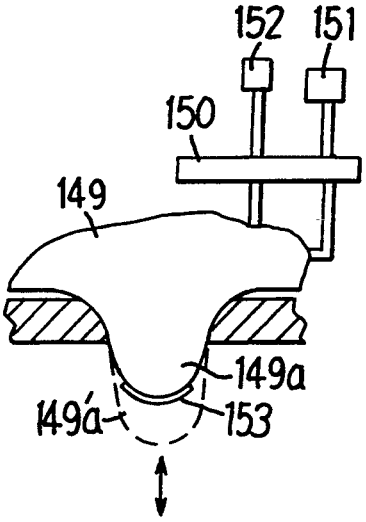
FIG. 28 shows a ninth embodiment of the second brake member.

FIG. 28 shows that an expandable member 149 can be used for obtaining expandable pins 149*a* which can be expanded and reduced as a function of the supply or emptying of media (gas and/or liquid) for the member. The supplying and emptying can be carried out in accordance with the exemplary embodiment in FIG. 28 using control valve 150, pressure source 151 and sump 152. By supplying media, the pin 149*a* can be made to expand to the form 149*a*' shown by broken lines, and by emptying the media from the member 149 the pin returns to its original shape 149*a*, etc. The expandable unit 149 can be reinforced with a reinforcing layer 153 at those parts which can cooperate with the yarn, in order to prevent undue wear. The member 149 consists of a hose or equivalent made of material which permits the said expansion at the parts 149*a* which can have a pin shape, teat shape etc. The member can be arranged around the surface 73*b* and can have a number of members 149*a* set out in both the breadthwise direction and peripheral direction of the member. The member can be made to cooperate with the outside of the balloon in order to form a friction surface with a varying coefficient of friction. Upon completion of actuation, the members 149*a* come into cooperation with the yarn in such a way that the latter is clamped to a greater or lesser extent against the surface 73*b* of the storing body as a function of the control actuations. In the final position, a definitive stopping of the yarn can be obtained. The member 149 can consist of a hose in which the wall thickness has been reduced at the said pin-shaped members 149*a*.

In general terms in FIG. 1 the brake unit comprises a funnel-shaped part which merges rearwards into a carrier tube for a yarn. The carrier tube extends inside an electromagnet whose associated connections (sic). The front of the funnel-shaped part acts against a counterstay surface on a hood-shaped part which is mounted in the storing body at its nose. The funnel-shaped member has a return spring and upon application of energy to the electromagnet presses the funnel-shaped member against the hood counter to the action of a spring. The hood is mounted in a part which is rotatably arranged in the body. The spring rests against a support which is longitudinally displaceable as a function of rotational movements of the part. The support is mounted in a central hexagonal column and the arrangement is such that the spring force can be adjusted as a function of longitudinal displacements of the part, which longitudinal displacements are determined by rotations of the part. In the event of controls via the lines, the yarn is clamped to a greater or lesser extent against the surface of the hood, for the purpose of producing a varied or modified braking during each drawing-off of the yarn.

The first and second brake members can operate in synchronous or asynchronous manner. A pre-stressing of the yarn part between the first and second brake members will be effected by the second brake member so that slackening does not occur on the yarn part between the first and second brake members. The yarn part can be monitored using members which detect the yarn tensioning and which, as a function of the yarn tensioning in the part between the first and second brake members, emit a signal which is fed back to the second brake member which, as a function of the fed-back signal, can adjust its braking effect (preliminary braking) on the yarn. The controls of the first and second brake members can also be provided in such a way that the control signals to the second brake member are slightly phase-displaced in relation to the control member for the first brake member, so that the action of the second brake member at all times lies ahead during the otherwise varied or modified braking function during the drawing-off process. The first and second brake members can also be designed with different mechanical inertias so that the phase-displaced actuation function for the brake members is obtained in those stages where the second brake member is principally to act.

The member(s) can also be designed with different degrees of rigidity as a function of controls. Volume expansion and reduction are not required, but can also be used as a supplementary feature in this case. In the slack state, the member exerts only slight or no braking resistance to the yarn. The braking capacity increases as the rigidity increases. The pins/needles can lie freely mounted in their bearings and, in the unactivated states, are moved aside by the yarn as it passes them.

In general terms, the following may be said in relation to FIGS. 5 to 5*f*. A wearing ring, for example of ceramic material, is secured on the yarn-storing body via an additional ring, preferably made of an energy-absorbing and/or damping material, advantageously a so-called viscoelastic material, for example expanded polyethylene. The wearing ring is advantageously designed with an L-shaped cross-section and is held in the brake member body in the brake unit by a diaphragm, for example. The control unit in the brake comprises an in this case axially movable coil which cooperates with a stationary permanent magnet in such a way that the coil, upon current application, moves in the axial direction, the direction of the current through the coil determining in which direction the coil moves. The return movement of the coil is therefore obtained simply by reversing the direction of current through the coil. A known measurement arrangement for the output yarn tensioning (actual) is shown. A heat-emitting member, for example a laser diode, microwave-generating source etc., is designed to heat-mark the passing yarn running out from the yarn feeder. A downstream member is arranged with a heat-detecting member, for example a conventional IR detector, which in this case detects the heat-marked yarn and is thus able to provide an expression of the actual speed of the passing yarn. A control unit is connected via lines to the said members and can feed back the actual yarn tensioning and/or yarn speed to the control member (or give this member a feed-back dependent on the tensioning or speed), which effects the clamping as a function of this detection so that the yarn-braking is controlled sinusoidally or in another form. Alternatively or in addition, the control unit can detect the machine angle in the textile machine. FIG. 5*a* shows the permanent magnet from the end. FIGS. 5*a* to 5*e* show different configurations of the interacting surfaces of the clamping and counterstay members, which interacting surfaces give different deflection functions for additive brake functioning. FIG. 5*f* shows a further exemplary embodiment where instead the permanent magnet is axially movable and forms a semicylindrical member (see the north and south poles drawn in the figure), which cooperates with two stationary current coils, and upon application of current thereto a forward or backward (depending on which of the current coils is exposed to current) axial displacement of the semicylindrical member is obtained, which member, with its actuation or clamping surface, thereby cooperates with variable pressing on the counterstay surface of the stationary yarn-storing body.

Figure 29:
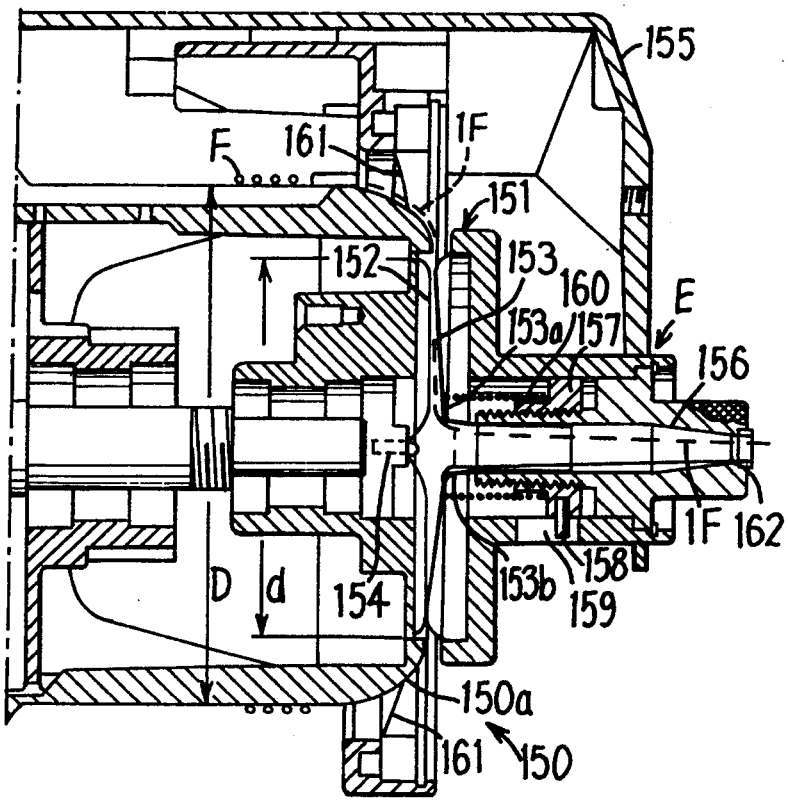
FIGS. 29 and 29*a* show, in a side view and in a partial cutaway view, two slightly different embodiments of a manual (so-called non-controlled) output brake of the abovementioned type.

In FIG. 29, reference number 150 indicates as a whole the output or drawing-off end of a thread-storing member, in this case a yarn feeder, for example for a weaving machine, and reference number 151 indicates as a whole an output brake/thread-tensioning generator. The brake comprises in this case a first surface-supporting part in the form of a first "plate" (disc) 152 and a second surface-supporting part in the form of a second "plate" (disc) 153. One of the plates can be replaced by flexible members, for example a brush/brush function. The said plates are advantageously made of a metal material, for example aluminium, which is preferably coated with a heat- and wear-resistant material, for example ceramic, in a manner known per se. The first plate is advantageously mounted in a tiltable manner on a pin 154 screwed into the drawing-off end and provided with a suitably round head, which pin 154 is intended to permit self-centring of the plate 152 (in relation to the plate 153) during the execution of the braking function. The second plate 153 is arranged in a unit E which is secured in the jib or crossbar 155 of the yarn-storing member. The plate 153 is secured at its inside part 153*a* in a tubular part 153*b*, which together form a member which has the shape of a funnel. The tubular part 153*b* is in turn mounted securely in a member 156 designed as a screw. The screw 156 is mounted in a central recess in the unit. On the screw 156 there is arranged a nut-shaped member 157 which has an internal screwthread which cooperates with an external screwthread on the screw 156. The nut 157 is provided with a guide pin 158 which cooperates with a longitudinal slot 159 in the unit E so that turning of the nut 157 is prevented when the screw 156 is turned. The rotational movement of the screw 156 can in this way be transmitted to the nut 157 as a linear movement in a direction to or from the drum 150. The nut 157 constitutes a support member for an internal spring 160 which extends to the "inside" of the second plate 153. The pressing force of the second plate 153 against the first plate 152 can therefore be adjusted by means of turning the screw 156. The guide pin 158 constitutes a suitable member for indicating to the operator the clamping or pressing force which is to be set in a particular operating case by means of the screw 156.

FIG. 29 also shows how a further thread-braking or control member 161 can be arranged so as to act in a manner known per se at the drawing-off edge 150*a* of the drum. This additional brake member, which consists for example of a so-called straw or brush ring of well known type in yarn feeder technology, is preferably designed to exert on the thread or the yarn a light braking or control function which is preferably adjustable (for example by means of longitudinal displacement of the brake relative to the here cone-shaped drawing-off edge of the drum). Alternatively, a thread balloon-breaking member of a similarly known type can replace the said additional brake member or complement the latter for suitable control of the thread or the yarn in this area.

The thread or yarn 1F which runs out during drawing-off from the yarn store on the yarn-storing member runs radially in between the plates 152 and 153 in the "plate brake" and towards their centre, a suitable (adjustable) initial tensioning of the thread being produced for the operating case in question. The thread 1F thereafter runs out through the central passage 1P in the funnel-shaped part and away from the yarn-storing member without being exposed on its way to any significant, undesired deflections increasing the tensioning. The screw 156 is advantageously provided with a central passage which advantageously comprises at its outlet a passage eye 162 preferably made of ceramic or similar material.

Figure 29A:
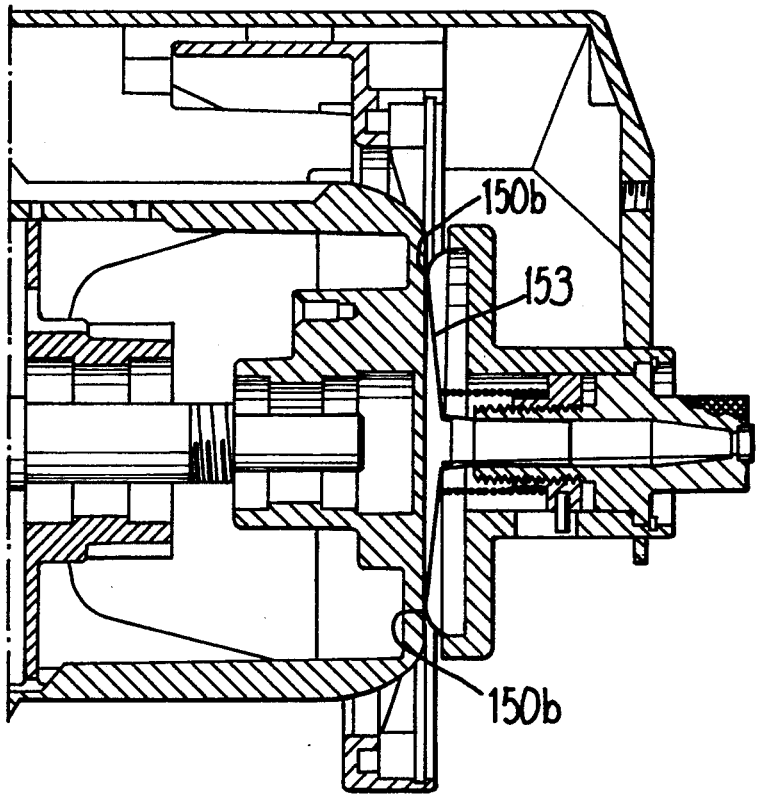

In the embodiment according to FIG. 29*a*, a simplification has been carried out to the extent that the first surface-supporting part does not consist of a "plate" as in FIG. 1, but instead of a part 150*b* of the end surface of the yarn-storing member, which part 150*b* is preferably surface-treated in a suitable manner and with which the second "plate" 153 is therefore designed to cooperate in order to impart to the thread or yarn a suitable tensioning during its drawing-off.

Figure 30:
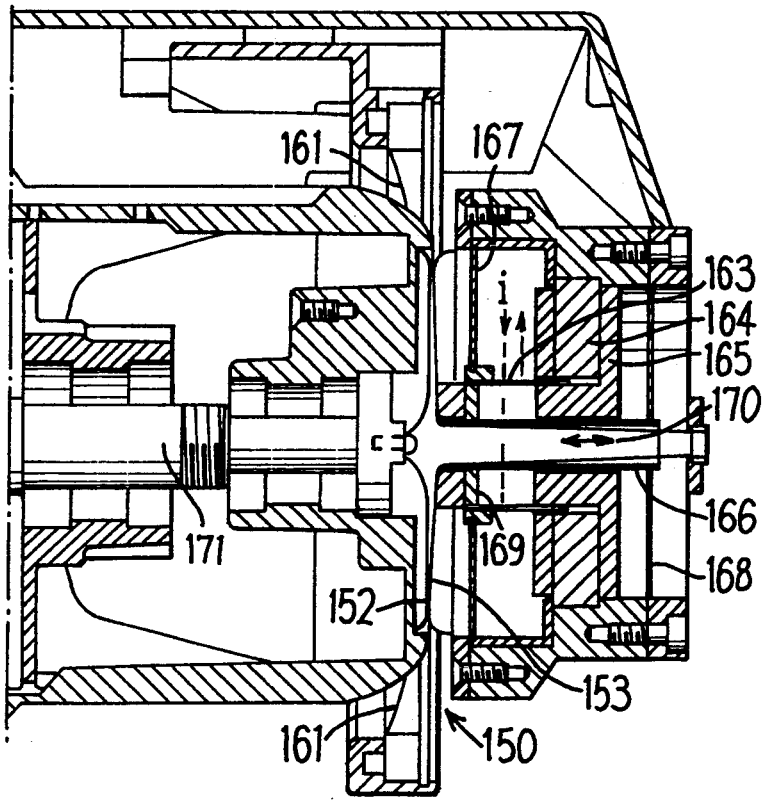
FIGS. 30 and 31 show, likewise in a side view and in a partial cutaway view, two slightly different embodiments of an electrically controlled output brake of principally the same type as in FIGS. 29 and 30.

FIG. 30 shows an example of an embodiment which permits rapid and effective control of the thread-tensioning/brake effect during one and the same thread drawing-off process (for example during one and the same weft pick). The embodiment works according to the principle applied to loud-speakers in the audio field. The coil, which is controlled by signals i, is designated by 163, a permanent magnet by 164 and a core of soft magnetic material by 165. The second surface-supporting part has in this case too the shape of a "plate" (disc) 153 and is secured in a bearing tube 166 so that the plate follows the longitudinal displacement movements of the tube 166 towards and away from the drum 150. The bearing tube is suspended in diaphragms 167, 168 of which there are two in the case shown. The attachment to the one diaphragm 167 is effected via a hub part 169, to which the coil is also attached. The longitudinal displacement movement 170, which coincides with the common longitudinal axis 171 of the drum 1 and the unit, of the coil is transferred to the hub part 169, which in turn carries with it the tube 166 and the second plate 153 arranged therein.

Figure 31:
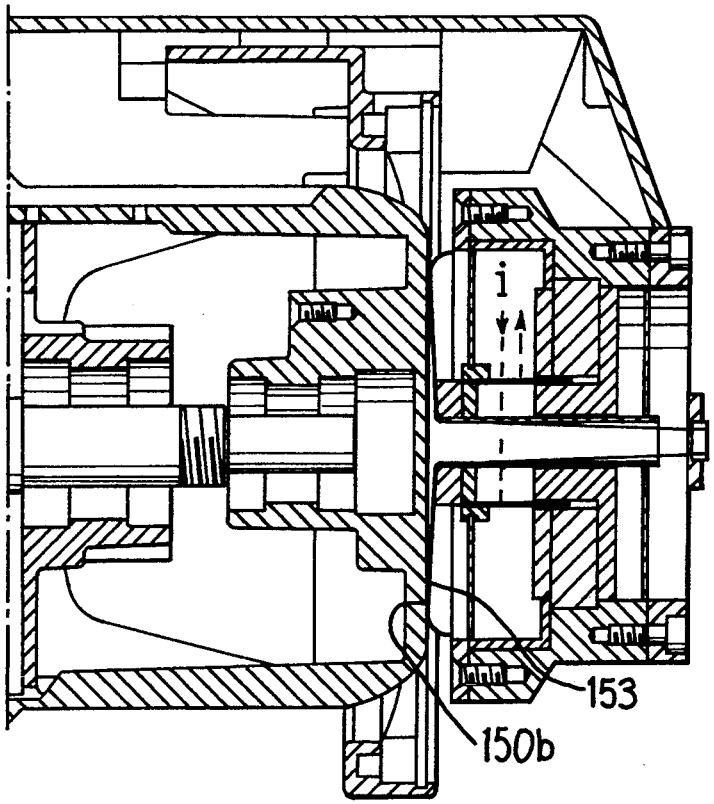

In FIG. 31 a simplification has been made, analogous to that shown in FIG. 29*a*, in comparison with the arrangement shown in FIG. 30, i.e. the second plate 153 is in this case designed to effect its braking function by cooperating directly with a part 150*b*′ on the end of the yarn-storing member, which part 150*b*′ is advantageously surface-treated (cf. FIG. 29). Otherwise, this embodiment corresponds to that shown in FIG. 30.

Figure 32:
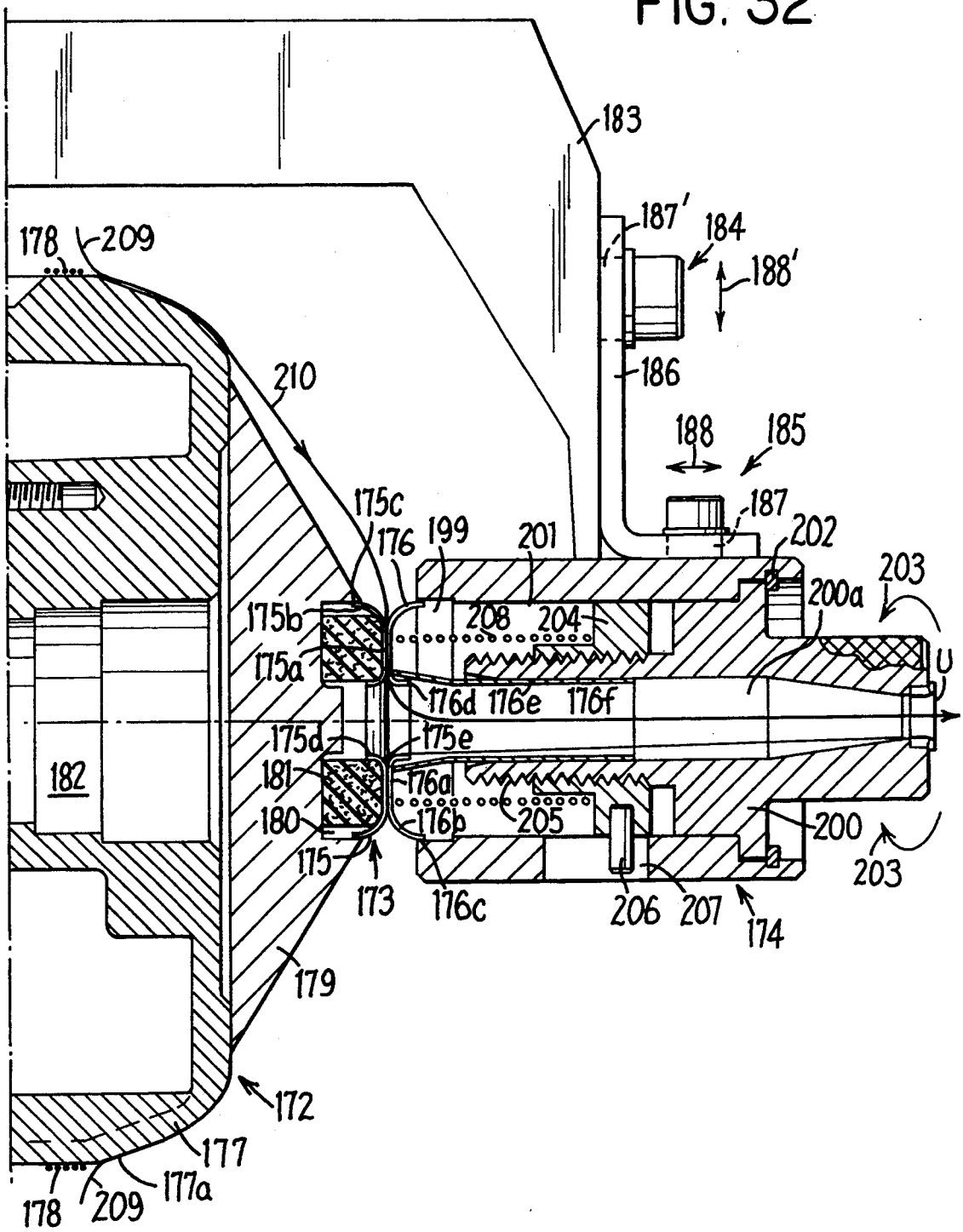
FIG. 32 shows, in a side view and in a partial cutaway view, a manual (non-controlled) embodiment of a brake.

In FIG. 32, the output part of a yarn-storing member, in this case a yarn feeder, for example for a weaving machine, is indicated by 172, and and output brake is indicated by 173 and 174. The brake in this case comprises a first surface-supporting part 175 and a second surface-supporting part 176. The brake part 173 is arranged in the drum 177 of the yarn feeder 172, which drum 177 in turn has a thread store 178 shown schematically. The said drum is provided with a part 179 which is designed as a truncated cone and can be screwed into the drum 177. The part 179 is provided at its outer section with a recess 180, in which the brake part 173 is arranged. The brake part 173 comprises, as surface-supporting part, a disc with a straight section 175*a* and a curved section 175*b*. The disc has the shape of a ring which is secured in the part 179 at its end edge 175*c*. The disc 175*a*, 175*b* is pre-stressed with a foamed plastic ring 181 which is held in place by the disc by virtue of the fact that its inner section 175*d* has a down-turned part or is flange-shaped and extends down over the inner surface of the foamed plastic ring. The disc is made of metal material which is preferably coated with a heat- and wear-resistant material, for example ceramic, in a manner known per se. The disc 175*a*, 175*b* will be resiliently actuable by means of the foamed plastic ring. Alternatively, the disc can also consist of a part which is completely separate in relation to the part 179 and which is mounted movably at its outer edge 175*c* and can also execute movements into and out from the drum. The main purpose of the foamed plastic ring is to adapt the movements and position of the disc in relation to the shaft (not shown) of the member 172, the space for which shaft has been indicated by 182. Any tendencies towards inclination of the shaft may mean that the disc 175*a*, 175*b* will have to be able to adapt to the second surface-supporting part 176 so that contact-bearing is achieved over the whole of the straight part 175*a*.

The unit 174 can be regarded as a free-standing part in relation to the drum 177. The unit is secured on the jib 183 of the member 1 by means of securing screws 184 and 185. The securing is effected by means of an L-shaped part which is provided with an extended hole 187 for the screw 185 and an extended hole 187′ for the screw 184, so that the unit 174 can be displaced longitudinally and radially in relation to the frame 1 in the direction of arrows 188 and 188′. The second surface-supporting part 176 is also designed as a disc with a straight part 176*a* and a curved part 176*b*. The straight part 176*a* can be pressed against the straight part 175*a* and the part 173. The disc 176*a*, 176*b* is guided in a recess 199 in the unit 174 via its outer edge 176*c*. The disc or the plate 176 is secured at its inner part 176*d* in a tubular part which, together with the parts 176*a*, 176*b*, 176*c* and 176*d*, forms a funnel-shaped member. The tube 176*e* is in turn firmly secured in a member 200 designed as a screw. The screw is mounted in a recess 201 in the housing 174 and is secured in the housing by means of a ring 202, which means that the screw can be turned in the direction of the arrows 203, but cannot be longitudinally displaced in the recess 201. On the screw there is arranged a nut-shaped member 204 which has an internal screwthread, via which the nut is screwed securely on an external screwthread 205 on the screw 200. The screw is provided with a guide member 206 guiding in a longitudinal slot 207. The guide member 206 and the slot 207 are in this case arranged in such a way that turning of the nut 204 is prevented when the screw 200 is turned. The rotational movement 203 of the screw can in this way be transmitted to the nut 204 as a linear movement in a direction to or from the drum 177. The nut constitutes a support member for an internal spring 208 which extends in the recess 201 between the support member 204 and the inside of the second surface-supporting part 176. The pressing force of the latter against the first surface-supporting part can thus be varied by means of rotations of the screw 200. The guide member/guide pin 206 and the slot 207 can in this case be regarded as constituting an indicating member for the pressing force which is to be set in a particular operating case by means of the screw 200. In FIG. 1, a second brake member is also indicated, which acts on the periphery 177*a* of the drum 177. This second brake member has been indicated by 209 and preferably exerts a light braking or controlling function on the thread. The thread part 210 running out from the yarn store 208 in question is led down between the straight parts 175*a* and 176*a* on the surface-supporting parts 175 and 176, respectively. The thread part is led further through the inside 176*f* of the funnel-shaped member. The screw is moreover provided with an internal continuous recess 200*a* which opens out via an outlet U which can comprise a ceramic ring or a member made of heat-resistant and wear-resistant material. The second surface-supporting part 176 is also designed with a coating of wear-resistant and heat-resistant material, for example ceramic or another material.

Figure 33:
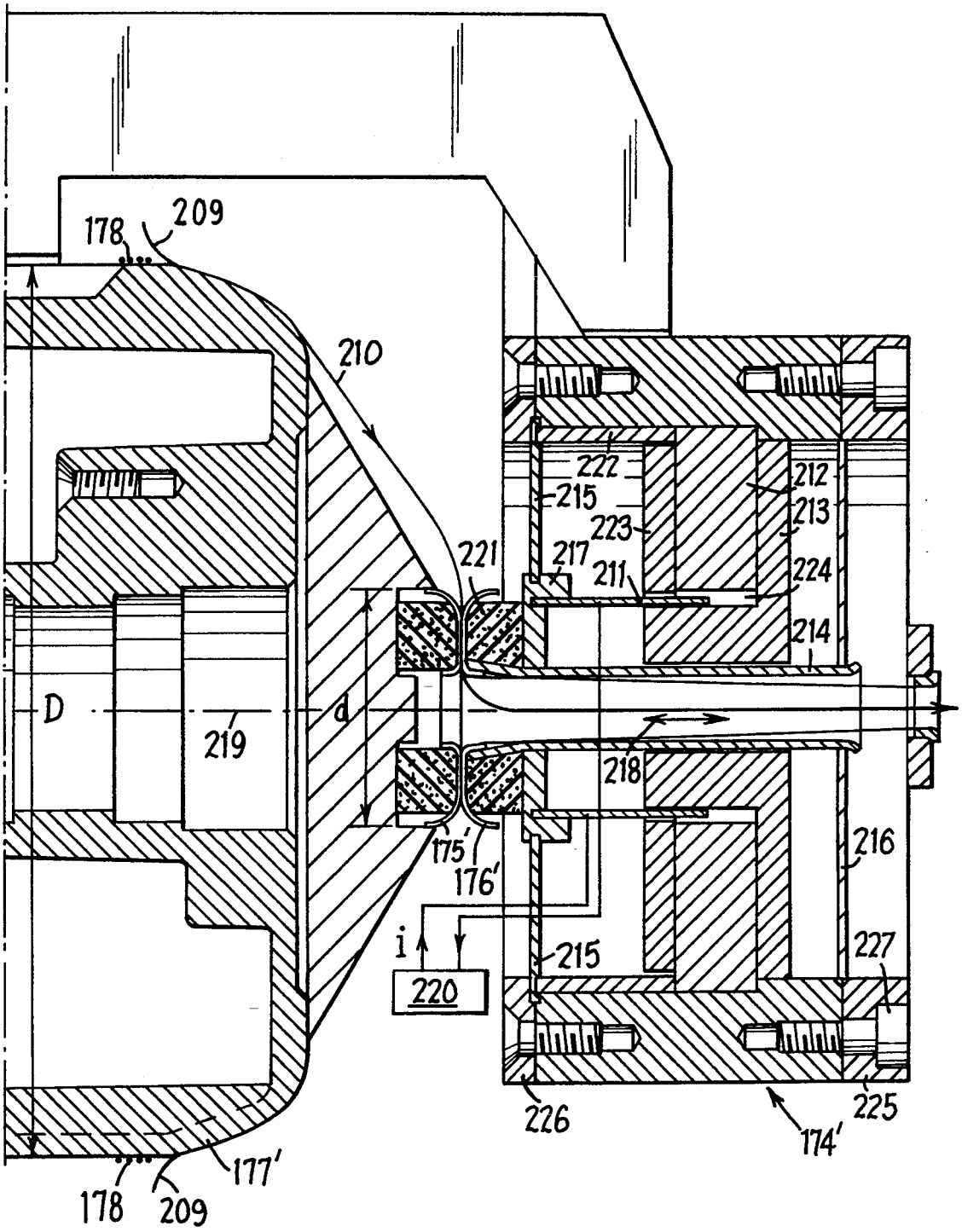
FIG. 33 shows, in a side view and in a partial cutaway view, an electrically controllable embodiment.

FIG. 33 shows an example of rapid and effective control of the thread tensioning/braking effect during the same thread drawing-off/weft pick. The embodiment functions in accordance with the principle applying to a voice coil. The coil is indicated by 211, a permanent magnet by 212, and an iron core (soft magnetic material) by 213. The second surface-supporting part is disc-shaped in this case too and is secured in a bearing tube 214 so that the part 176' follows the longitudinal displacement movements of the tube 214 towards and away from the drum 177'. The bearing tube is suspended in diaphragms 215, 216, of which there are two in the case shown. The attachment to the one diaphragm 215 is effected via a hub part 217, to which the coil is also attached. The longitudinal displacement movement 218, which coincides with the common longitudinal axis 219 of the drum 177' and the unit 174', of the coil is transmitted to the hub part 217, which in turn carries with it the tube 214 and the second part 176' arranged therein. The movement 218 of the coil 211 is produced with the aid of a control unit 220 which generates control signals i. The arrangement is characterised by great sensitivity and great speed. The second surface-supporting part 5' is "dampened lightly" in this case with the aid of foamed plastic material, for example a foamed plastic ring 221 (compare the corresponding ring 181 in FIG. 32). The magnet 212 is secured by parts 222, 223 made of non-magnetic material. The part 222 is also used for the clamping function for the diaphragm 215. The coil is secured in the hub 217 and can move freely in a space 224 under the permanent magnet 212. The diaphragm 216 is clamped with the aid of a locking cap 225 for the unit 174'. Corresponding clamping of the diaphragm 215 is obtained with a second locking cap 226. The cylinders and walls 225, 226 of the unit are held together with retention screws 227. As regards the drum and the brake member part 173', these components have a design corresponding to that described for FIG. 32.

In the present case, the diameters d of the first and second surface-supporting parts 175', 176' are the same size or essentially the same size. Said diameter d is essentially reduced in relation to the diameter D of the thread store. In one exemplary embodiment, d is chosen as 10–40% of D. d should be at most 50% of D. The surfaces on the straight leaf-spring parts **175*a*, 175*a'* and 176*a*, 176*a'* are about 5% of the cross-sectional area of the drum 177, 177'**, taken at said diameter D for the yarn store.

Said FIG. 32 also shows how a further thread brake member (thread-tensioning generator) can be designed in a manner known per se to act on the drawing-off edge of the drum. This additional brake member, which consists for example of a straw or brush ring of a type well known per se in yarn feeder technology, is preferably designed to exert a light braking or control function on the thread, which function is preferably adjustable (for example by means of longitudinal displacement of the brake relative to the here cone-shaped drawing-off edge of the drum). Alternatively, a thread balloon-breaking member of similarly known type can replace the said additional brake member or complement the latter for suitable control of the thread in this area.

Figure 34:
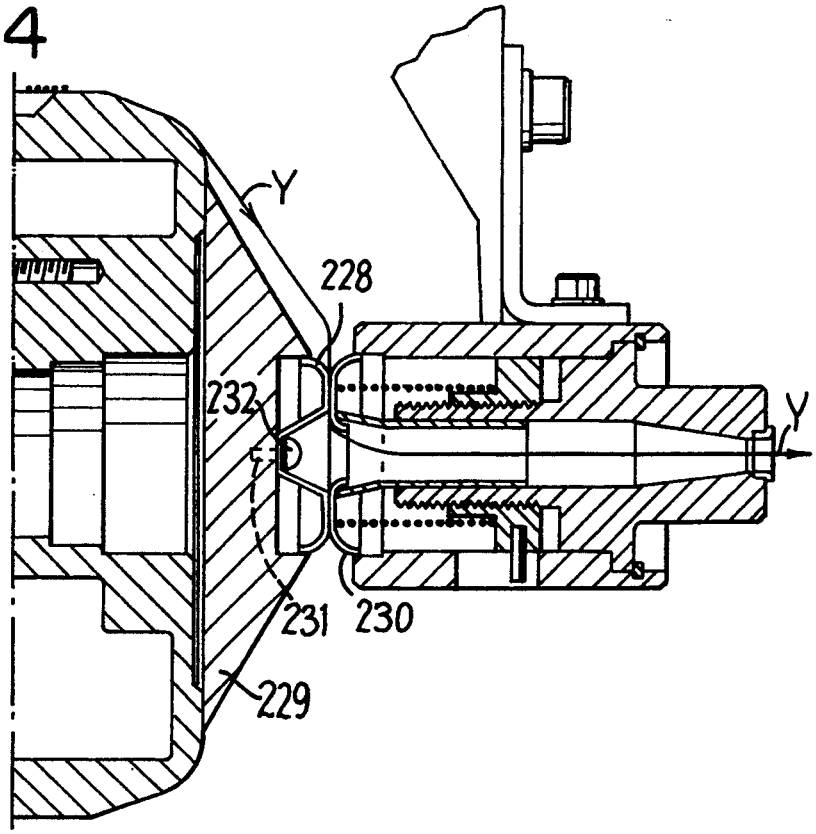
FIG. 34 shows in longitudinal section an embodiment with parallel-positioned plate members.

Since, in a further development of the invention according to FIG. 34, the brake disc 228 in the spool body nose 229 in the thread-storing member (yarn feeder) is designed with a cone-shaped center, this disc can be allowed to tilt around this center point and thereby adapt to the position of the spring-loaded counter-brake disc 230. In order to hold the disc 228 in position, securing can be achieved via a small hole 231 in the center, preferably by means of a pin-shaped member 232 secured in the spool body nose 229, this securing being achieved with play so that said tilting movement is allowed to occur.

Via a cavity C in the center of the "fixed" brake disc 233, the tip of a threading needle N, preferably of a type known per se, can be threaded in until the opening of the threading needle comes into a position of cooperation with the gap between the brake discs 233 and 234. By using the rotational movement of the yarn Y upon drawing-off from the spool body 229, the yarn Y can be easily captured by the "hook" of the threading needle N, by which means a simple threading through the brake is possible.

In the case of linty threads or yarns, however, an accumulation of fibres etc. can occur in the cavity, which would constitute a risk to the thread/yarn running through. This risk can be eliminated by virtue of the fact that, in accordance with this additional further development of the invention, the "bottom" of the cavity C is designed to "spring back". During threading, the threading needle N in this case pushes back, counter to the action of a counterforce (for example generated by a spring S), a preferably cylindrical, essentially axially displaceable body B which is designed, in the absence of the threading needle in the position of cooperation, to return, for example by means of said spring S, to its rest position and thereby to fill the said cavity C so that said accumulation of fibres does not take place.

In order for the yarn to run correctly through the output brake, it is important that the yarn part guided between the first member 9 and the counterstay member 15 and "renewed" continuously during the drawing-off of the yarn should execute in the brake a movement which essentially corresponds to the movement of pointer rotating clockwise or counterclockwise, cf. the pointer on a clock face. This pointer movement for the yarn part situated between the counterstay surfaces also guarantees an effective yarn cleaning function. The said pointer movement can also be seen as an angular movement of the yarn part. In order to ensure that this pointer movement actually takes place, it has proven particularly advantageous, although not necessary, to give the yarn a comparatively low and preferably as low as possible (since this itself contributes tensioning to the yarn) holding or control tension between the yarn store on the yarn feeder drum and the output brake, which, so to speak, exerts a counterforce MF which has an opposite direction in comparison with the drawing-off force AF of the yarn. This holding or control tension can be produced with a braking/tensioning member which is separate from the "main brake" (see, for example, 71 in FIG. 10; 161 in FIGS. 29, 30; 209 in FIGS. 32, 33; TR in FIGS. 36, 37, 38). The said holding or control tension is preferably adjustable (see earlier description of this in the description) and can be simply set by studying the appearance of the yarn in the "main brake" (ensuring that the said "pointer movement" actually takes place correctly). In certain operating cases, a holding or control force of a few cN may be sufficient, while in other cases it may prove necessary to increase this force considerably.

Figure 35:
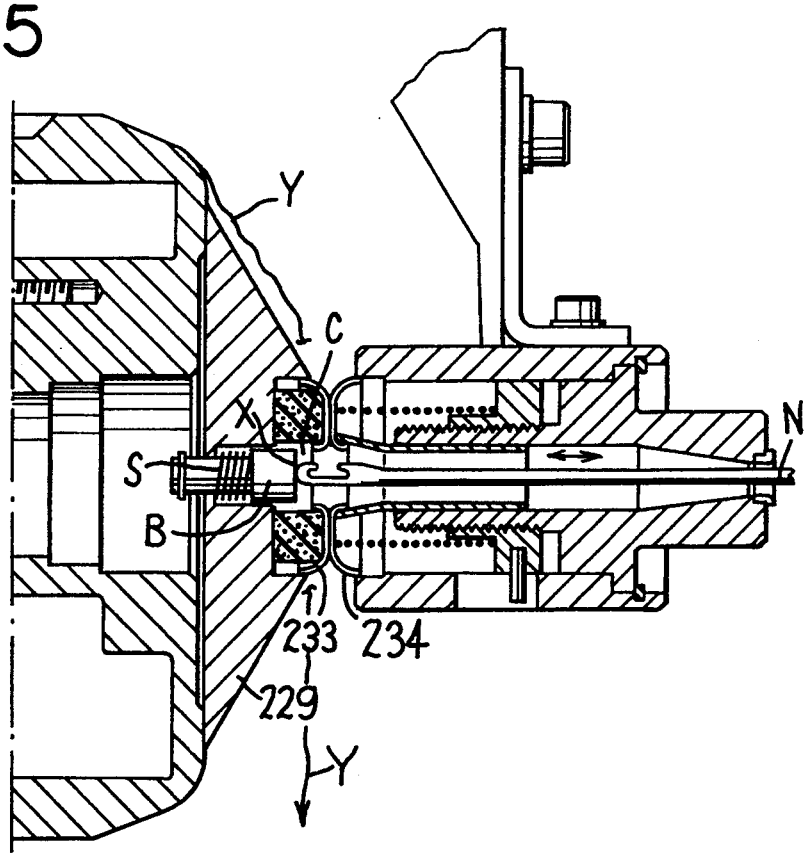
FIG. 35 shows in longitudinal section a cavity for threading of thread through the brakes.
Figure 36:
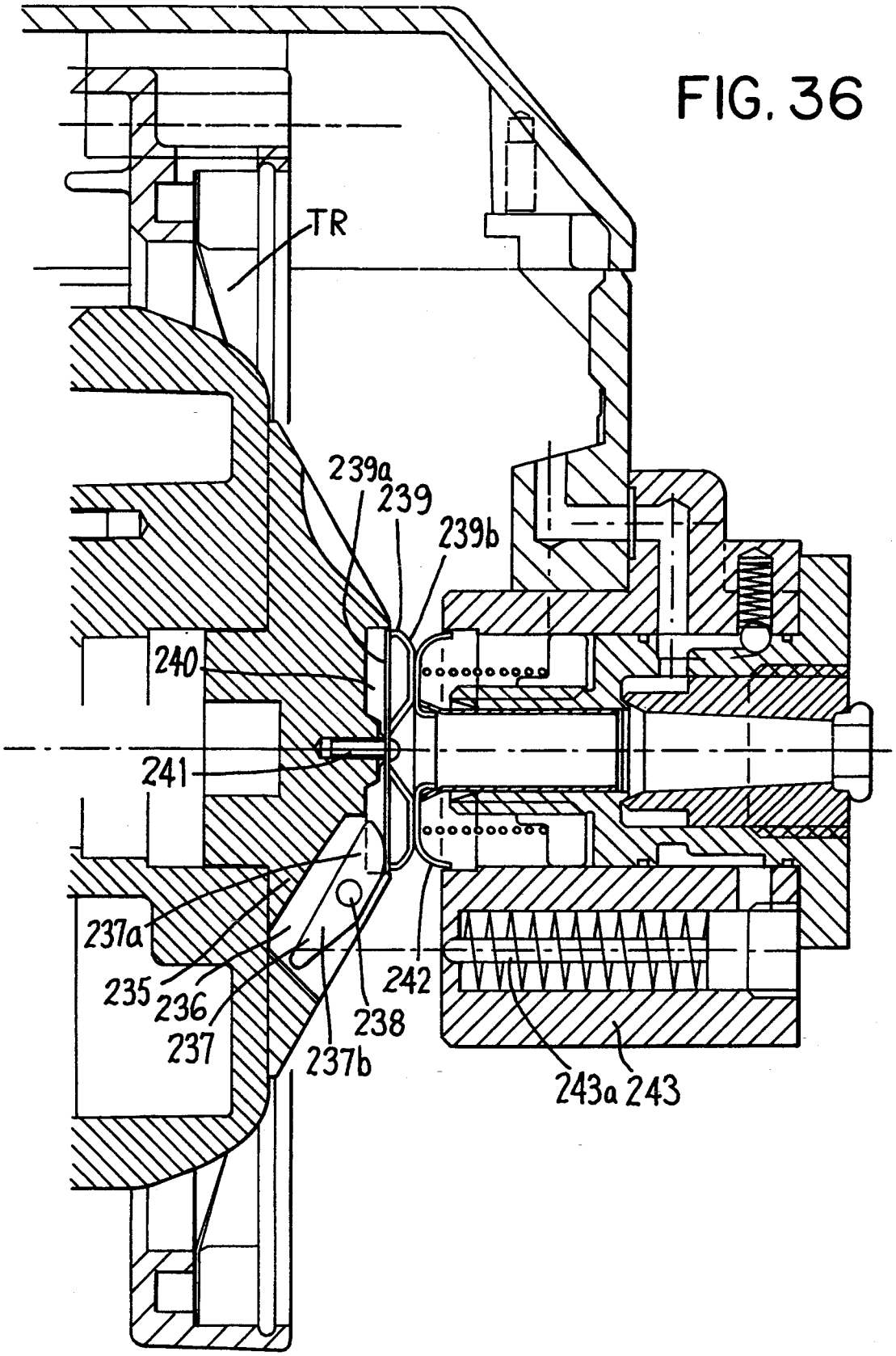
FIGS. 36–38 show in longitudinal section a nose brake arrangement with air threading-up function.
Figure 37:
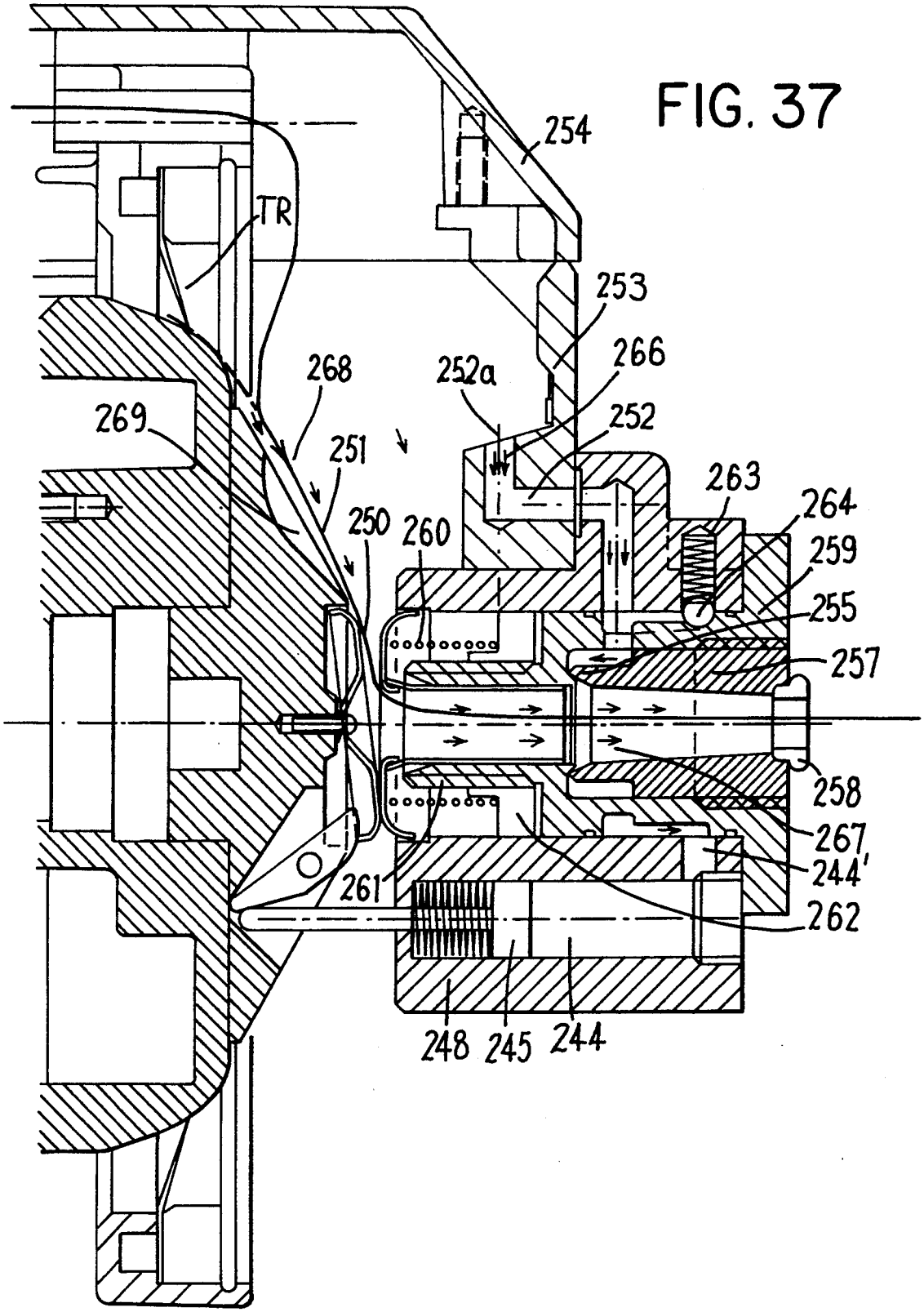
Figure 38:
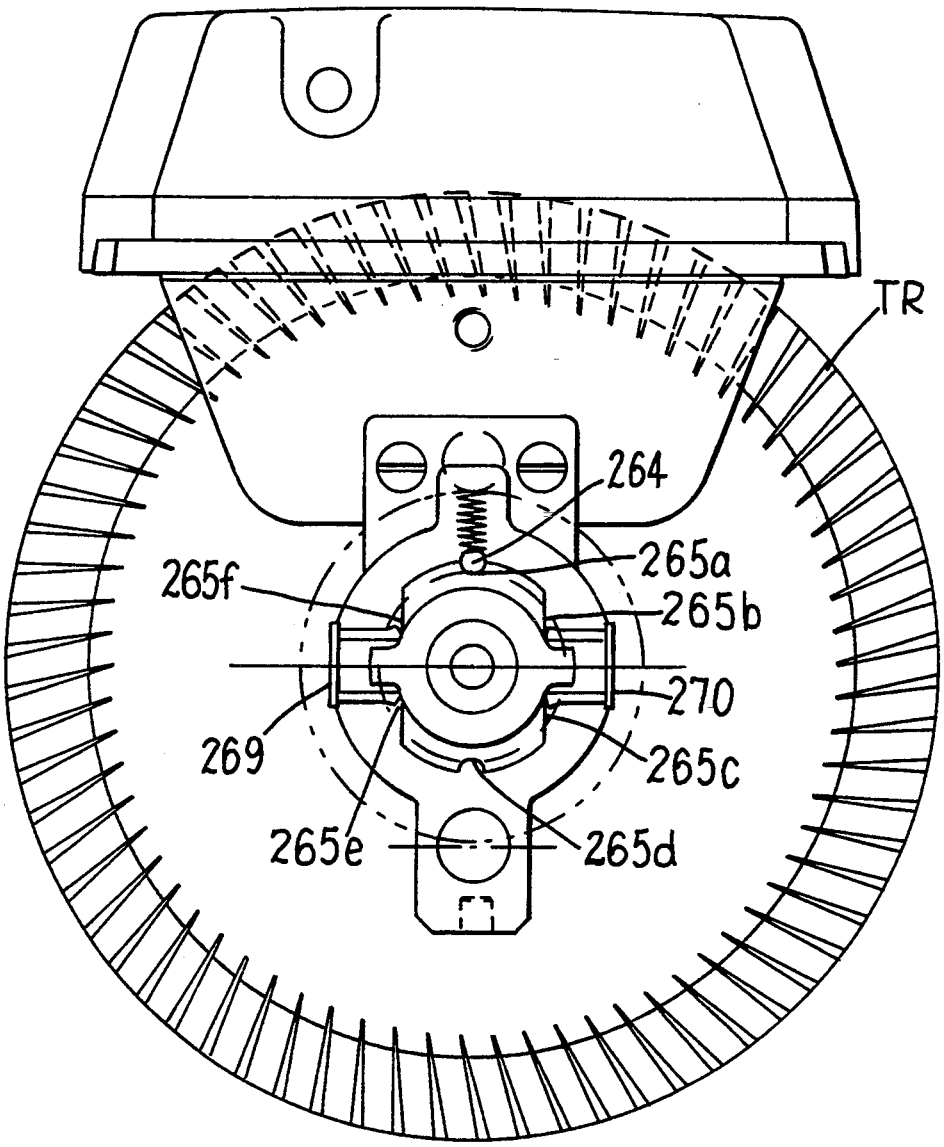

FIGS. 36, 37 and 38 show an air threading-up arrangement on an easily moveable output brake system in accordance with the above. The air threading-up arrangement is, however, not in itself associated with the features stated above, but can be used generally with suitable modifications in conjunction with output brakes. This applies in itself also to the embodiment according to FIG. 35. In FIG. 36, the spool body nose is indicated by 235. The spool body nose is provided with a recess 236 in which an activation device 237 is arranged. In the exemplary embodiment, the activation device has the form of a tiltable member which is rotatably arranged at its central parts on a bearing shaft 238 arranged in the spool body nose. In this exemplary embodiment, the counterstay member has, as in most of the previously mentioned embodiments, the form of a small plate which has a rear edge 239*a* and a front part 239*b* which supports or forms the clamping surface of the counterstay member for the yarn. The counterstay member is arranged in a recess 240 and is supported at its central parts in the spool body nose by means of a bearing screw or journal 241 so that the counterstay member can in principle be inclined in relation to the first member 242 which is designed in this case too as a plate. The tiltable member 237 bears in a starting position against the rear edge 239*a* of the counterstay member via its first end 237*a*. The other end 237*b* of the tiltable member 237 can be acted upon by an activation member 243 which comprises a longitudinally displaceable part 243*a* which, upon activation by the activation member 243, comes into cooperation with the tilting member 237, see FIG. 37. This activation brings about the said inclination of the counterstay member 239. The counterstay member 239 is thus secured with suitable play for permitting the said inclination at the head end of the screw (241) (journal).

In this exemplary embodiment, the activation member 243 has the form of a compressed air cylinder which comprises a piston 245 which is longitudinally displaceable in a cylinder space 244. The said activation part 243*a* (piston rod) is connected to the said piston 245. The piston is displaceable with a working medium, suitably the same compressed air which is used for threading and supporting the yarn (see the inlet port 244' in FIG. 37). The activation of the piston by means of the control medium takes place counter to the action of a spring 248 arranged in the cylinder space. When the compressed air cylinder is deactivated, the piston is thus forced back by the spring 248. The spring 248 is arranged between an end surface in the cylinder space 244 and the piston 245. Upon deactivation of the compressed air cylinder, the spring function (see 260) of the member 242 returns the tilting member 237 to the starting position according to FIG. 36.

Activation of the member 243 results, according to FIG. 37, in a separating gap 250 arising between the clamping surface 239*c* of the counterstay member and the clamping surface 242*a* of the first member 242. The separating gap 250 occurs at the diametrally opposite side in relation to the effect of the tilting member 237 on the counterstay member. A yarn end 251 can be drawn down into the separating gap 250 which thus appears (preferably drawn in by the ejector procedure described hereinbelow).

The air threading-up arrangement also comprises a channel 252 for air or medium of another type which is used for the threading function. The channel is arranged in the frame part 253 of the nose brake, by means of which the nose brake is secured in the partially shown crossbar 254 of the yarn feeder, preferably at its outer end which is indicated in FIG. 37. The channel 252 has an inlet 252*a* into the said frame part 253. A compressed air or medium source of another type is connected or can be connected to the said inlet 252. The said source is not shown in FIG. 37. The channel 252 leads down to one or more ejector members 255 which are preferably of a type known per se. The ejector member can be included in a part 257 which can be screwed into or applied to the nose brake and which, at the output of the nose brake, is provided with an eye 258 of wear-resistant material, for example ceramic material. The said part 257 can be arranged in an adjusting screw 259, which comprises a recess for the said part 257. The adjusting screw 259 is used in order to effect a variable clamping force between the first member 242 and the counterstay member 239. The adjusting screw can be assigned different degrees of turning into the nose body (previously described in detail). A spring 260 determining the clamping force is influenced as a function of the degree of turning. In the case of a fairly high degree of turning, the first member 242 bears against the counterstay member 239 with a greater bearing force than in the case of a lower degree of turning. The adjusting screw has an external thread 261 which cooperates with a corresponding internal thread on a longitudinally displaceable part 262 in the nose body. The adjusting screw can preferably be set in distinct rotational positions by means of snap members which, in the exemplary embodiment, consist of a ball or balls 264 which can be loaded by spring members 263. The said ball or balls cooperate(s) with recesses 265 (here six in number) in the adjusting screw. Upon adjustment to a first distinct rotational position, the ball or balls is/are thus pressed down into one of the said recesses. In a second rotational position of the adjusting screw, the ball or balls is/are pressed down into another of the recesses, etc.

The source of medium for the (automatic) threading function can be activated in a manner known per se. Upon this activation, a flow of medium 266 is produced in the channel 252, and the ejector function is thus activated in the central hole for passing the yarn through the brake. The yarn is drawn in by virtue of the fact that the yarn end 251 is applied by suitable manual or automatic means in the area of the gap or opening 250 formed by means of the tilting member 237. The ejector function in fact brings about a media flow indicated by 267 and means that air, indicated by 268, is drawn down or sucked into the gap 250 formed between the member 242 and the counterstay member 239. In order to facilitate the flow of air in the spool body nose, the latter is provided with a depression, preferably a bowl-shaped depression 269.

FIG. 38 shows an exemplary embodiment in which a ball 264 with associated spring member 263 is used in the snap function for the adjusting screw 259. A number of recesses (here six) 265*a*, 265*b*, 265*c*, 265*d*, 265*e* and 265*f* afford the same number of distinct rotational positions of the adjusting screw 259. Windows 269, 270, for example made of perspex, are arranged in order to permit visual indication of the degree of turning of the adjusting screw, i.e. the yarn tensioning set in the brake. The function and structure of parts and components not described hereinabove should be clear from the context. A method for (automatic) threading according to the invention can be regarded as being characterised by the fact that activation members are activated for relative inclination of the first member and the counterstay member in order to establish a gap or opening 250 for the yarn end in question. This end is applied to the gap, and an ejector function effected in the output channel for the yarn is started and the yarn end is drawn down or sucked into and through the output channel. When the threading is completed, the activation for the inclination of the first member and the counterstay member is deactivated, as is the ejector function, both of which functions, as has been previously mentioned, are thus advantageously designed to be controlled with the same flow of medium.

The present invention is not limited to the embodiments described above and shown in the drawings, but instead a great many variations are possible within the scope of the inventive concept under consideration.

We claim:

1. A yard braking system for use at an output side of a yarn feeding device, the yarn feeding device including a yarn storage surface member and an output surface member, the output surface member guiding a yarn from the storage surface member to an output channel extending coaxially downstream from the output surface member along a longitudinal central axis of the yarn feeding device, the yarn braking system comprising a first clamping member associated with the yarn feeding device and a second clamping member associated with a yarn brake coaxially positioned downstream from the yarn feeding device, the clamping members being relatively movable along the longitudinal axis and having respectively a first clamping surface and a second annular clamping surface associated therewith, the yarn passing in an axial movement outwardly over the first clamping surface and then passing inwardly through the second annular clamping surface before entering the output channel during a withdrawal of the yarn, the yarn braking system further comprising means for urging at least one of the clamping members against the other one of the clamping members to effect a selectable basic yarn clamping force acting on the yarn passing between the clamping surfaces, and means for independently and instantaneously varying the yarn clamping force by relatively movably repositioning at least one of the clamping members during the withdrawal of the yarn from the yarn feeding device.

2. The yarn braking system as claimed in claim 1, wherein at least one of the clamping surfaces is resilient.

3. The yarn braking system as claimed in claim 1, wherein a diameter of each of the first and second clamping surfaces is less than about 50% of a diameter of the yarn storage surface member.

4. The yarn braking system as claimed in claim 3, wherein the diameters of the clamping surfaces are preferably in the range of about 10%–40% of the diameter of the yarn storage surface member.

5. The yarn braking system as claimed in claim 1, wherein the yarn braking system further comprises means for cleaning lint and particle material from the yarn passing between the clamping surfaces, and means for preventing accumulation of the material on the clamping surfaces.

6. The yarn braking system as claimed in claim 1, wherein at least one of the clamping surfaces includes means for yielding from an initial clamping position in response to an irregularity in the yarn before returning to the initial clamping position after the irregularity has passed through the clamping surfaces during the withdrawal of the yarn.

7. The yarn braking system as claimed in claim 1, wherein the first clamping member includes a cup-like member having an annular circumferentially continuous base portion extending downstream from a free upstream edge thereof, the annular base portion being oriented in a plane transverse to the longitudinal central axis and defining the first clamping surface.

8. The yarn braking system as claimed in claim 7, wherein a flange extends radially outwardly from the free upstream edge of the cup-like member, the flange limiting longitudinal downstream movement of the first clamping member with respect to the output surface member.

9. The yarn braking system as claimed in claim 1, wherein the urging means includes a longitudinally movable coaxial support member positioned upstream from the first clamping member and having a radial flange extending in a plane transverse to the axis, and a spring disposed between the radial flange and the first clamping surface, the yarn clamping force being applied to the first and second clamping surfaces being adjustable in accordance with the longitudinal position of the support member.

10. The yarn braking system as claimed in claim 9, wherein the urging means further includes a hollow substantially cylindrical rotatable housing portion rotatably supported in the yarn feeding device, the rotatable housing portion encompassing the support member, the spring and the first clamping member; the rotatable housing portion defining the output surface member and an internally threaded portion which threadably engages with the radial flange of the support member; the support member, the spring and the first clamping member being longitudinally movable with respect to the rotatable housing portion to effect the yarn clamping force.

11. The yarn braking system as claimed in claim 9, wherein the spring consists at least in part of foamed plastic material.

12. The yarn braking system as claimed in claim 1, wherein the first clamping member is a fixed annular ceramic ring associated with the output surface member which defines the first clamping surface.

13. The yarn braking system as claimed in claim 1, wherein the urging means includes means for manually adjusting the position of the second clamping member along the central axis with respect to the first clamping member.

14. The yarn braking system as claimed in claim 13, wherein the means for manually adjusting includes a support arm fixedly extending from the yarn feeding device, an adjusting screw rotatably supported by a flange attached to the support arm, a frame member which supports the second clamping member and which is suspended from a sleeve slidably engaged with the support arm, and a threaded bore through the frame member, a free end of the screw being threadably engaged with the bore so that a rotation of the screw effects a change in position of the second clamping member along the central axis relative to the yarn feeding device in order to vary the yarn clamping force.

15. The yarn braking system as claimed in claim 13, wherein the position of the second clamping member can be varied to generate the yarn clamping force against the yarn in a range of about 1–100 grams force.

16. The yarn braking system as claimed in claim 15, wherein the varying means includes electromechanical means for varying the clamping force generated by the clamping members against the yarn.

17. The yarn braking system as claimed in claim 1, wherein the second clamping member includes a cone-shaped portion and a hollow cylindrical portion extending downstream from the cone-shaped portion which defines the output channel.

18. The yarn braking system as claimed in claim 17, wherein the varying means includes an annular magnet encompassing the cylindrical portion, and a coil associated with the second clamping member which effects a movement of the second clamping member along the longitudinal axis in response to a control signal from a control unit operably coupled to the coil, the movement of the second clamping member effecting a variation in the clamping force being applied to the yarn by the first and second clamping surfaces.

19. The yarn braking system as claimed in claim 18, wherein the varying means further includes a spring member disposed between an upstream surface of the magnet and the second clamping surface to effect a return movement of the second clamping member along the axis.

20. The yarn braking system as claimed in claim 19, wherein the spring member consists at least in part of foamed plastic material.

21. The yarn braking system as claimed in claim 18, wherein the varying means further includes an adjusting assembly fixedly positioned relative to the yarn feeding device, the adjusting assembly including a frame member supporting the magnet, a first annular diaphragm which resiliently couples an upstream edge of the cone-shaped to the frame member, and a second annular diaphragm which resiliently couples a downstream edge of the cylindrical portion to the frame member.

22. The yarn braking system as claimed in claim 17, wherein the second annular clamping surface is resiliently suspended, circumferentially continuous, and extends radially outwardly from a free upstream edge of the cone-shaped portion in a plane extending transverse to the longitudinal central axis.

23. The yarn braking system as claimed in claim 22, wherein a flange extends downstream and radially outwardly from a free radially outer edge of the second annular clamping surface.

24. The yarn braking system as claimed in claim 17, wherein the second clamping member further includes a plurality of laminae each extending radially inwardly and downstream from, fixedly secured to, and pivotable about a free upstream edge of the cone-shaped portion, free end portions of the laminae contacting the first clamping surface and cooperating to define the second annular clamping surface, the second annular clamping surface being resilient and circumferentially intermittent.

25. The yarn braking system as claimed in claim 24, wherein the urging means includes an adjusting assembly fixedly positioned relative to the yarn feeding device, the adjusting assembly including a frame member which supports the second clamping member along the longitudinal axis relative to the yarn feeding device, a first annular diaphragm which resiliently couples a free upstream edge of the cone-shaped portion to the frame member, and a second annular diaphragm which resiliently couples a free downstream edge of the cylindrical portion to the frame member, the frame member.

26. The yarn braking system as claimed in claim 24, wherein the urging means includes a support arm fixedly extending from the yarn feeding device, an adjusting screw rotatably supported by a flange attached to the support arm, a frame member which supports the second clamping member and which is suspended from a sleeve slidably engaged with the support arm, and a threaded bore through the frame member, a free end of the screw being threadably engaged with the bore so that a rotation of the screw effects a change in position of the second clamping member along the central axis relative to the yarn feeding device.

27. The yarn braking system as claimed in claim 26, wherein the varying means includes a bellows having a first end fixedly secured to the free upstream edge of the cone-shaped portion, and a second end fixedly secured to the frame member, the first end of the bellows effecting a movement of the second clamping member relative to the frame member along the longitudinal axis in response to a control signal from a control unit.

28. The yarn braking system as claimed in claim 27 wherein the bellows is coupled to a pressure source by a pressure line, the pressure source varying a quantity of media supplied to the bellows in accordance with the control signal, the movement of the second clamping member effecting a variation in the yarn clamping force being applied by the first and second clamping surfaces, and the control unit being coupled to a plurality of other control units by a communication channel.

29. The yarn braking system as claimed in claim 1, wherein the second clamping member includes an annular bellows having a central funnel-shaped region extending downstream from an upstream free edge of the bellows, and a plurality of laminae each extending radially inwardly and downstream from, fixedly secured to, and pivotable about the free upstream edge, free end portions of the laminae contacting the first clamping surface and cooperating to define the second annular clamping surface, and the second annular clamping surface being resilient and circumferentially intermittent.

30. The yarn braking system as claimed in claim 29, wherein the urging means includes a support arm fixedly extending from the yarn feeding device, and adjusting screw rotatably supported by a flange attached to the support arm, a frame member which supports a downstream end of the bellows and which is suspended from a sleeve slidably engaged with the support arm, and a threaded bore through the frame member, a free end of the screw being threadably engaged with the bore so that a rotation of the screw effects a change in position of at least the downstream end of the bellows along the central axis relative to the yarn feeding device, and the frame member having an outlet member extending therethrough which defines the outlet channel.

31. The yarn braking system as claimed in claim 30, wherein the varying means includes a pressure source coupled to the bellows which effects a movement of the free upstream edge of the bellows along the longitudinal axis in response to a control signal from a control unit operably coupled to the pressure source, the movement of the free upstream edge of the bellows effecting a variation in the yarn clamping force being applied by the first and second clamping surfaces.

32. The yarn braking system as claimed in claim 1, wherein the varying means includes means responsive to a command from a control unit for modifying the clamping force applied by the second clamping member to the first clamping member and the yarn.

33. The yarn braking system as claimed in claim 32, wherein the varying means is adapted to alter the clamping force sinusoidally.

34. The yarn braking system as claimed in claim 1, wherein the varying means includes means for feedback controlling the clamping force by displacing the second clamping member along the central axis as a function of at least one of a yarn tension parameter and a yarn speed parameter based upon a detected heat marking.

35. The yarn braking system as claimed in claim 1, wherein the yarn feeding device further comprises a second yarn brake associated with the yarn storage surface member, the second yarn brake including means for preventing the yarn from slackening when the yarn decelerates during a final portion of the withdrawal of the yarn thus preventing unacceptable entangling of the yarn between the first-mentioned and the second yarn brakes.

36. The yarn braking system as claimed in claim 35, wherein the second yarn brake further includes means for preliminarily braking the yarn relative to the first-mentioned yarn brake to effect a stretching of the yarn during the withdrawal of the yarn, monitoring means for detecting a tension in the yarn at a point between the first-mentioned and second yarn brakes, and means for controlling the second yarn brake as a function of the tension.

37. The yarn braking system as claimed in claim 35, wherein the second yarn brake includes an annular member encompassing the yarn storage surface member and being displaceable along the central axis, and a plurality of resilient bristle-shaped elements extending each extending radially inwardly and secured to the annular member, free end portions of the bristle-shaped elements contacting the yarn storage surface member.

38. The yarn braking system as claimed in claim 1, wherein the first and second clamping surfaces are oriented in a plane extending perpendicular to the longitudinal central axis.

39. The yarn braking system as claimed in claim 1, further including means for threading the yarn through the second clamping member.

40. The yarn braking system as claimed in claim 39, wherein the means for threading includes means for inclining the first clamping member relative to the second clamping member to form a separating gap channel between the first and second clamping surfaces, and means for generating an air stream in the output channel to create a flow of air from the yarn storage surface member along the output surface member, through the gap channel, and into the outlet channel which draws a free end of the yarn into and through the outlet channel.

41. The yarn braking system as claimed in claim 40, wherein the means for threading is automatic and is initiated by activation of the inclining means.

42. The yarn braking system as claimed in claim 40, wherein the first clamping member is pivotally coupled to the output surface member by a central bearing screw extending along the central axis, and wherein the inclining means includes a pressure cylinder associated with the yarn brake and a pivotal rocker arm associated with the output surface member, the rocker arm having a first end which contacts an upstream surface of the first clamping member, the cylinder having an actuatable extendable plunger arm which contacts a second end of the rocker arm and drivingly rotates the rocker arm about a pivotal axis thereof to cause the first end to drivingly incline the first clamping member.

43. The yarn braking system as claimed in claim 42, wherein the pressure cylinder includes a piston coupled to the plunger which drivingly extends the plunger in response to compressed air introduced into the pressure cylinder, and a spring which biases the plunger within the pressure cylinder absent the compressed air.

44. The yarn braking system as claimed in claim 40, wherein the output surface member includes at least one depression which facilitates the flow of air across the output surface member.

45. The yarn braking system as claimed in claim 40, wherein the air stream generating means includes an air supply channel associated with the yarn brake which supplies a pressurized air to a plurality of ejectors communicating with the outlet channel, the ejectors discharging the pressurized air into the outlet channel to create the flow of air.

46. The yarn braking system as claimed in claim 1, wherein the varying means is adapted to be responsive to a control unit.

47. The yarn braking system as claimed in claim 46, wherein the control unit includes means for providing a control signal to effect a sinusoidal variation in the selectable yarn clamping force.

48. The yarn braking system as claimed in claim 46, wherein the control unit is operably coupled to at least one higher ranking control unit by a communication channel.

49. A yarn braking system for use at an output side of a yarn feeding device, the yarn feeding device including a yarn storage surface member and an output surface member, the output surface member guiding a yarn from the storage surface member to an output channel extending coaxially downstream from the output surface member along a longitudinal central axis of the yarn feeding device, the yarn braking system comprising a first clamping member associated with the yarn feeding device and a second clamping member associated with a yarn brake coaxially positioned downstream from the yarn feeding device, the clamping members being relatively movable along the longitudinal axis and having respectively a first clamping surface and a second annular clamping surface associated therewith, the yarn passing in an axial movement outwardly over the first clamping surface and then passing inwardly through the second annular clamping surface before entering the output channel during a withdrawal of the yarn, the yarn braking system further comprising means for urging the second clamping member against the first clamping member to effect a selectable basic yarn clamping force acting on the yarn passing between the clamping surfaces, the urging means including a spring member adjacently provided at a downstream side of the second clamping surface which urges the second clamping member against the first clamping member, and an adjusting means for selectably varying the clamping force generated by the spring member.

50. The yarn braking system as claimed in claim 49, wherein the adjusting means includes a rotatable adjusting screw rotatably supported in a yarn brake housing, and a tubular support member threadably engaged with the adjusting screw and being displaceable along the longitudinal axis relative to the adjusting screw, the spring member being positioned between the second clamping member and the support member so that a rotation of the adjusting screw effects a change in position of the support member thus adjusting the clamping force applied to the yarn.

51. The yarn braking system as claimed in claim 50, wherein the adjusting means further includes means for selecting a predetermined clamping force value.

52. The yarn braking system as claimed in claim 51, wherein the selecting means includes a plurality of detents circumferentially-spaced around the adjusting screw, and a recess extending through the yarn brake housing which supports a spring and ball assembly, the ball being urged into one of the plurality of detents by the spring which corresponds to a discrete predetermined clamping force.

53. The yarn braking system as claimed in claim 52, wherein clamping force selecting means includes an inspection window for visually indicating a position of the adjusting screw.

54. The yarn braking system as claimed in claim 49, further including means for threading the yarn through the second clamping member.

55. The yarn braking system as claimed in claim 54, wherein the means for threading includes means for inclining the first clamping member relative to the second clamping member to form a separating gap channel between the first and second clamping surfaces, and means for generating an air stream in the output channel to create a flow of air from the yarn storage surface member along the output surface member, through the gap channel, and into the outlet channel which draws a free end of the yarn into and through the outlet channel.

56. The yarn braking system as claimed in claim 55, wherein the first clamping member is pivotally coupled to the output surface member by a central bearing screw extending along the central axis, and wherein the inclining means includes a pressure cylinder associated with the yarn brake and a pivotal rocker arm associated with the output surface member, the rocker arm having a first end which contacts an upstream surface of the first clamping member, the cylinder having an actuatable extendable plunger arm which contacts a second end of the rocker arm and drivingly rotates the rocker arm about a pivotal axis thereof to cause the first end to drivingly incline the first clamping member.

57. The yarn braking system as claimed in claim 56, wherein the pressure cylinder includes a piston coupled to the plunger which drivingly extends the plunger in response to compressed air introduced into the pressure cylinder, and a spring which biases the plunger within the pressure cylinder absent the compressed air.

58. The yarn braking system as claimed in claim 55, wherein the output surface member includes at least one depression which facilitates the flow of air across the output surface member.

59. The yarn braking system as claimed in claim 55, wherein the air stream generating means includes an air supply channel associated with the yarn brake which supplies a pressurized air to a plurality of ejectors communicating with the outlet channel, the ejectors discharging the pressurized air into the outlet channel to create the flow of air.

* * * * *

UNITED STATES PATENT AND TRADEMARK OFFICE

CERTIFICATE OF CORRECTION

PATENT NO. : 5,343,899

DATED : September 6, 1994

INVENTOR(S) : Kurt A. G. Jacobsson, et al

It is certified that error appears in the above-indentified patent and that said Letters Patent is hereby corrected as shown below:

Column 33, line 12; change "yard" to ---yarn---.

Signed and Sealed this

Twenty-eight Day of February, 1995

*Attest:*

Bruce Lehman

BRUCE LEHMAN

*Attesting Officer*

*Commissioner of Patents and Trademarks*